US010476212B2

(12) United States Patent
Bopp et al.

(10) Patent No.: US 10,476,212 B2
(45) Date of Patent: Nov. 12, 2019

(54) ELECTRICAL CONNECTOR WITH SHIELD CAP AND SHIELDED TERMINALS

(71) Applicant: CommScope Technologies LLC, Hickory, NC (US)

(72) Inventors: Steven Richard Bopp, Jamestown, NC (US); Paul John Pepe, Clemmons, NC (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 0 days.

(21) Appl. No.: 15/802,867

(22) Filed: Nov. 3, 2017

(65) Prior Publication Data

US 2018/0309247 A1 Oct. 25, 2018

Related U.S. Application Data

(62) Division of application No. 14/694,393, filed on Apr. 23, 2015, now Pat. No. 9,847,607.

(Continued)

(51) Int. Cl.
*H01R 24/00* (2011.01)
*H01R 13/6599* (2011.01)

(Continued)

(52) U.S. Cl.
CPC ..... *H01R 13/6599* (2013.01); *H01R 4/2429* (2013.01); *H01R 13/42* (2013.01);

(Continued)

(58) Field of Classification Search
CPC ... H01R 23/025; H01R 13/112; H01R 23/005

(Continued)

(56) References Cited

U.S. PATENT DOCUMENTS 3,401,369 A * 9/1968 Roche ..... H01R 23/6873 219/541
3,474,387 A * 10/1969 Krum ..... H01R 12/89 439/260

(Continued)

FOREIGN PATENT DOCUMENTS

CN 102232259 A 11/2011
EP 0 603 667 A2 6/1994

(Continued)

OTHER PUBLICATIONS

International Search Report and Written Opinion for Application No. PCT/US2015/027159 dated Aug. 5, 2015.

(Continued)

*Primary Examiner* — Thanh Tam T Le
(74) *Attorney, Agent, or Firm* — Merchant & Gould P.C.

(57) ABSTRACT

A shield cap is mounted to an electrical connector for reducing crosstalk between adjoining electrical connectors. The shield cap includes a body portion and opposite shield plates. The body portion is configured to engage the electrical connector and is formed from a non-conductive material. The opposite shield plates are connected to opposite sides of the body portion and configured to at least partially cover one or more insulation displacement contacts exposed from the electrical connector. The electrical connector includes a wire termination conductor configured to be connected to a wire conductor of a cable. The wire termination conductor is at least partially coated with a shielding layer.

16 Claims, 16 Drawing Sheets

Related U.S. Application Data

(60) Provisional application No. 61/982,958, filed on Apr. 23, 2014.

(51) Int. Cl.

| | |
|---|---|
| ***H01R 4/2429*** | (2018.01) |
| ***H01R 13/42*** | (2006.01) |
| ***H01R 13/6461*** | (2011.01) |
| *H01R 13/506* | (2006.01) |
| *H01R 24/64* | (2011.01) |

(52) U.S. Cl.
CPC ..... *H01R 13/6461* (2013.01); *H01R 13/506* (2013.01); *H01R 24/64* (2013.01)

(58) Field of Classification Search
USPC ..... 439/620.11, 620.17, 620.23, 676, 856, 439/941
See application file for complete search history.

(56) References Cited

U.S. PATENT DOCUMENTS 3,958,851 A 5/1976 Evans
4,080,027 A * 3/1978 Benasutti ..... H01R 12/89 439/260
4,337,989 A 7/1982 Asick et al.
4,522,211 A * 6/1985 Bare ..... A61B 5/04087 439/325
4,546,542 A * 10/1985 Proud ..... H01R 43/16 29/564.6
4,588,240 A * 5/1986 Ruehl ..... H01R 31/08 439/513
4,662,702 A * 5/1987 Furuya ..... H01R 13/03 439/630
4,773,878 A 9/1988 Hansell, III
4,784,609 A 11/1988 Lau
4,878,858 A 11/1989 Dechelette
5,017,156 A 5/1991 Sugiyama
5,064,387 A 11/1991 Lybrand
5,073,130 A 12/1991 Nakamura
5,083,945 A 1/1992 Miskin et al.
5,125,854 A 6/1992 Bassler et al.
5,127,845 A 7/1992 Ayer et al.
5,207,597 A 5/1993 Kline et al.
5,222,909 A 6/1993 Nomura et al.
5,256,086 A 10/1993 Ponn
5,263,883 A * 11/1993 Kirayoglu ..... H01R 43/16 439/856
5,277,592 A * 1/1994 Morlion ..... H01R 12/737 439/65
5,281,169 A 1/1994 Kiat et al.
5,288,248 A 2/1994 Chen
5,290,177 A 3/1994 Chal
5,312,273 A 5/1994 Andre et al.
5,316,507 A * 5/1994 Capp ..... C10M 103/04 439/886
5,326,281 A 7/1994 Yin
5,338,227 A 8/1994 Nakamura
5,378,172 A 1/1995 Roberts
5,380,223 A 1/1995 Marsh et al.
5,397,250 A 3/1995 Briones
5,505,625 A * 4/1996 Byer ..... H01R 12/82 439/62
5,509,824 A 4/1996 Rodrigues et al.
5,531,606 A 7/1996 Rodrigues et al.
5,531,612 A 7/1996 Goodall et al.
5,538,440 A 7/1996 Rodrigues et al.
5,564,949 A 10/1996 Wellinsky
5,584,727 A 12/1996 Miller et al.
5,586,911 A 12/1996 Miller et al.
5,593,311 A 1/1997 Lybrand
5,599,206 A 2/1997 Slack et al.
5,599,595 A * 2/1997 McGinley ..... H01R 13/035 428/33
5,603,639 A 2/1997 Lai et al.
5,622,523 A 4/1997 Kan et al.
5,628,653 A 5/1997 Haas et al.
5,637,014 A 6/1997 Sukegawa et al.
5,637,015 A 6/1997 Tan et al.
5,639,262 A 6/1997 Lim
5,647,765 A 7/1997 Haas et al.
5,651,701 A 7/1997 Chen
5,676,559 A * 10/1997 Laub ..... H01R 12/62 439/260
5,685,739 A 11/1997 Davis et al.
5,685,740 A 11/1997 Lim
5,688,145 A 11/1997 Liu
5,702,271 A 12/1997 Steinman
5,718,605 A 2/1998 Morikawa et al.
5,722,859 A 3/1998 Chen
5,738,544 A 4/1998 Davis
5,755,595 A 5/1998 Davis et al.
5,788,538 A 8/1998 Belopolsky et al.
5,791,943 A 8/1998 Lo et al.
5,830,015 A 11/1998 Rodrigues et al.
5,908,331 A 6/1999 Hsu et al.
5,913,698 A 6/1999 Keng
5,924,890 A 7/1999 Morin et al.
5,934,940 A 8/1999 Maranto et al.
5,938,476 A 8/1999 Wu et al.
5,944,559 A 8/1999 Wu
5,954,540 A 9/1999 Wu
5,980,320 A 11/1999 Slack et al.
5,984,726 A 11/1999 Wu
6,007,382 A 12/1999 Wu
6,027,375 A 2/2000 Wu
6,050,854 A 4/2000 Fang et al.
6,053,773 A 4/2000 Wu
6,059,581 A 5/2000 Wu
6,059,607 A 5/2000 Wilson
6,066,001 A 5/2000 Liptak et al.
6,077,120 A 6/2000 Futatsugi et al.
6,077,122 A 6/2000 Elkhatib et al.
6,086,420 A 7/2000 Wu
6,086,429 A 7/2000 Wu
6,093,058 A 7/2000 Wu
6,095,862 A 8/2000 Doye et al.
6,099,327 A 8/2000 Chen
6,113,426 A 9/2000 Lin
6,113,427 A 9/2000 Wu
6,126,476 A 10/2000 Viklund et al.
6,132,253 A 10/2000 Wu
6,135,815 A 10/2000 Ko et al.
6,139,364 A 10/2000 Beutler et al.
6,139,365 A 10/2000 Lok
6,139,367 A 10/2000 Yeh
6,142,828 A 11/2000 Pepe
6,146,205 A 11/2000 Lai
6,155,872 A 12/2000 Wu
6,165,015 A 12/2000 Wu et al.
6,165,016 A 12/2000 Lai
6,168,466 B1 1/2001 Chiou
6,168,467 B1 1/2001 Chiou
6,171,150 B1 1/2001 Saito et al.
6,174,198 B1 1/2001 Wu et al.
6,179,661 B1 1/2001 Chiou
6,183,292 B1 2/2001 Chen et al.
6,186,830 B1 2/2001 Lin et al.
6,190,205 B1 2/2001 Wu
6,193,552 B1 2/2001 Chiou et al.
6,193,554 B1 2/2001 Wu
6,203,336 B1 3/2001 Nakamura
6,203,373 B1 3/2001 Lin
6,203,374 B1 3/2001 Huang et al.
6,203,375 B1 3/2001 Chang
6,206,730 B1 3/2001 Avery et al.
6,210,224 B1 4/2001 Wu
6,210,226 B1 4/2001 Zhu et al.
6,210,231 B1 4/2001 Lai
6,210,235 B1 4/2001 Wu
6,210,237 B1 4/2001 Chang
6,217,378 B1 4/2001 Wu
6,220,895 B1 4/2001 Lin

(56) References Cited

U.S. PATENT DOCUMENTS 6,227,910 B1 5/2001 Huang
6,234,841 B1 5/2001 Chang et al.
6,250,964 B1 6/2001 Fair et al.
6,257,929 B1 7/2001 Wang
6,257,931 B1 7/2001 Sakurai et al.
6,264,504 B1 7/2001 Wu
6,276,966 B1 8/2001 Yamoto et al.
6,287,147 B1 9/2001 Lin
6,287,148 B1 9/2001 Huang
6,287,149 B1 9/2001 Elkhatib et al.
6,290,535 B1 9/2001 Lin et al.
6,290,538 B1 9/2001 Pocrass
6,296,521 B1 10/2001 Chang et al.
6,299,487 B1 10/2001 Lopata et al.
6,302,737 B1 10/2001 Billman
6,315,608 B1 11/2001 Lopata et al.
6,319,062 B1 11/2001 Ma et al.
6,319,063 B1 11/2001 Huang
6,322,396 B1 11/2001 Kuan
6,325,672 B1 12/2001 Belopolsky et al.
6,328,601 B1 12/2001 Yip et al.
6,335,869 B1 1/2002 Branch et al.
6,336,827 B1 1/2002 Akama et al.
6,341,986 B1 1/2002 Ko
6,347,961 B2 2/2002 Zhu et al.
6,354,875 B1 3/2002 Wu
6,354,877 B1 3/2002 Shuey et al.
6,354,879 B1 3/2002 Plehaty
6,358,066 B1 3/2002 Gilliland et al.
6,358,091 B1 3/2002 Lo et al.
6,361,367 B1 3/2002 Daikuhara et al.
6,364,707 B1 4/2002 Wang
6,364,708 B1 4/2002 Chen et al.
6,368,153 B1 4/2002 Hwang
6,371,810 B1 4/2002 Iwasaki
6,375,505 B1 4/2002 Lin
6,375,510 B2 4/2002 Asao
6,379,184 B1 4/2002 Bassler et al.
6,379,185 B2 4/2002 Belopolsky et al.
6,383,023 B1 5/2002 Chang et al.
6,383,024 B1 5/2002 Wang et al.
6,383,025 B1 5/2002 Shi et al.
6,390,852 B1 5/2002 Wang
6,407,932 B1 6/2002 Gaio et al.
6,409,542 B1 6/2002 Ivey, Jr. et al.
6,409,547 B1 * 6/2002 Reede ..... H01R 13/6464 439/676
6,416,031 B1 7/2002 Billman
6,416,358 B1 7/2002 Kamarauskas et al.
6,416,360 B1 7/2002 Zhang et al.
6,416,361 B1 7/2002 Hwang
6,431,887 B1 8/2002 Yeomans et al.
6,435,912 B1 8/2002 Zhu et al.
6,435,915 B1 8/2002 Chen
6,442,831 B1 * 9/2002 Khandros ..... H05K 3/4015 228/188
6,443,768 B1 9/2002 Dirkers et al.
6,447,311 B1 9/2002 Hu et al.
6,450,835 B1 9/2002 Lee
6,478,621 B2 11/2002 Ma et al.
6,478,622 B1 11/2002 Hwang
6,478,623 B1 11/2002 Wu
6,482,037 B1 11/2002 Zhu et al.
6,488,550 B1 * 12/2002 Kikuchi ..... H01R 13/112 439/857
6,494,741 B2 12/2002 Handa et al.
6,494,744 B1 12/2002 Lee
6,497,588 B1 12/2002 Scharf et al.
6,506,075 B2 1/2003 Chiran et al.
6,506,076 B2 1/2003 Cohen et al.
6,508,660 B2 1/2003 Self
6,508,670 B1 1/2003 Hwang
6,508,671 B2 1/2003 Ko
6,517,382 B2 2/2003 Flickinger et al.
6,520,799 B1 2/2003 Cheng et al.
6,524,120 B2 2/2003 Zhao
6,524,134 B2 2/2003 Flickinger et al.
6,527,564 B1 3/2003 Yeh
6,527,593 B2 3/2003 Handa et al.
6,530,809 B2 3/2003 Handa et al.
6,533,615 B2 3/2003 Koide et al.
6,540,555 B1 4/2003 Festag et al.
6,540,563 B1 4/2003 Hu et al.
6,554,642 B1 4/2003 Xiang et al.
6,554,648 B2 4/2003 Shi et al.
6,558,191 B2 5/2003 Bright et al.
6,558,196 B2 5/2003 Festag
6,561,849 B2 5/2003 Naito et al.
6,565,388 B1 5/2003 Van Woensel et al.
6,572,411 B1 6/2003 Aeschbacher et al.
6,575,789 B2 6/2003 Bassler et al.
6,582,252 B1 6/2003 Lin
6,582,255 B2 6/2003 Simmons et al.
6,595,801 B1 7/2003 Leonard et al.
6,599,151 B2 7/2003 Chiran et al.
6,604,964 B2 8/2003 Hoshino et al.
6,607,308 B2 8/2003 Dair et al.
6,619,984 B2 9/2003 Liu
6,619,986 B1 9/2003 Yeh
6,619,987 B2 9/2003 Kumamoto et al.
6,623,307 B2 9/2003 Korsunsky et al.
6,629,857 B1 10/2003 Ma et al.
6,629,858 B2 10/2003 Lo et al.
6,629,859 B2 10/2003 Hoshino et al.
6,641,438 B1 11/2003 Billman
6,652,317 B2 11/2003 Shao
6,652,320 B2 11/2003 Inagawa et al.
6,655,995 B1 12/2003 Reisinger et al.
6,659,655 B2 12/2003 Dair et al.
6,663,415 B1 12/2003 Wu
6,663,432 B2 12/2003 Inagawa
6,666,719 B1 12/2003 Kuroi et al.
6,666,720 B1 12/2003 Reisinger et al.
6,669,514 B2 12/2003 Wiebking et al.
6,674,652 B2 1/2004 Forte et al.
6,682,368 B2 1/2004 Murr et al.
6,685,504 B1 2/2004 Espenshade
6,685,505 B1 2/2004 Espenshade et al.
6,685,511 B2 2/2004 Akama et al.
6,688,914 B1 2/2004 Espenshade et al.
6,688,915 B2 2/2004 Moriwake et al.
6,699,074 B1 3/2004 Wu et al.
6,702,616 B1 3/2004 Chang et al.
6,705,894 B1 3/2004 Comerci et al.
6,709,290 B2 3/2004 Yoshida
6,709,291 B1 3/2004 Wallace et al.
6,709,292 B1 3/2004 Barefoot
6,716,057 B1 4/2004 Wu
6,729,905 B1 5/2004 Hwang
6,729,906 B1 5/2004 Simmons et al.
6,733,332 B1 5/2004 Espenshade et al.
6,752,663 B2 6/2004 Bright et al.
6,758,696 B2 * 7/2004 Farnworth ..... H01L 25/0657 439/632
6,764,340 B2 7/2004 Toda
6,776,629 B2 8/2004 Shuey
6,776,665 B2 8/2004 Huang
6,780,054 B2 8/2004 Yip et al.
6,783,406 B2 * 8/2004 Keiser ..... H01R 4/4881 439/827
6,786,742 B2 9/2004 Matsuoka
6,786,770 B1 9/2004 Huang
6,793,527 B2 9/2004 Noro
6,793,531 B1 9/2004 Zhang
6,799,997 B2 10/2004 Lin et al.
6,802,740 B1 10/2004 Fan et al.
6,805,586 B2 10/2004 Akama et al.
6,811,438 B1 11/2004 Ko
6,811,439 B1 11/2004 Shin-Ting
6,814,612 B1 11/2004 Hu et al.
6,821,149 B2 11/2004 Lai
6,821,151 B2 11/2004 Lai
6,830,480 B2 12/2004 Yoshioka
6,835,092 B2 12/2004 Wan et al.

(56) References Cited

U.S. PATENT DOCUMENTS 6,837,742 B1 1/2005 Chou et al.
6,840,798 B2 1/2005 Kobayashi
6,848,943 B2 2/2005 Machado et al.
6,851,979 B2 2/2005 Yen
6,857,904 B2 2/2005 Lai
6,863,569 B2 3/2005 Zhu et al.
6,865,369 B2 3/2005 Semmeling et al.
6,866,539 B2 3/2005 Chang
6,866,544 B1 3/2005 Casey et al.
6,870,746 B2 3/2005 Leeson et al.
6,874,953 B2 4/2005 Dair et al.
6,875,031 B1 4/2005 Korsunsky et al.
6,875,055 B2 4/2005 Chu et al.
6,878,012 B2 4/2005 Gutierrez et al.
6,884,117 B2 4/2005 Korsunsky et al.
6,884,937 B1 4/2005 Mistry et al.
6,893,270 B2 5/2005 Sercu
6,893,272 B2 5/2005 Yu
6,893,293 B2 5/2005 Ice et al.
6,893,294 B2 5/2005 Moriyama et al.
6,902,432 B2 6/2005 Morikawa et al.
6,908,339 B2 6/2005 Tanaka
6,913,485 B2 7/2005 Ko
6,913,487 B2 7/2005 Beneke et al.
6,913,489 B2 7/2005 Chai et al.
6,918,791 B2 7/2005 Wan et al.
6,921,292 B2 7/2005 Miyazaki
6,926,540 B1 8/2005 Juntwait
6,926,551 B1 8/2005 Schulz et al.
6,926,557 B1 8/2005 Yamaguchi
6,929,512 B2 8/2005 Lai
6,932,640 B1 8/2005 Sung
6,932,647 B2 8/2005 Murayama
6,937,205 B2 8/2005 Chou et al.
6,939,143 B2 * 9/2005 Rathburn ..... H01L 23/49811 257/E23.067
6,939,172 B2 9/2005 Lu
6,942,521 B1 9/2005 Jatou et al.
6,943,287 B2 9/2005 Lloyd et al.
6,948,965 B2 9/2005 Kumamoto et al.
6,948,979 B2 9/2005 Chien et al.
6,948,980 B2 9/2005 Xiang et al.
6,953,361 B2 10/2005 Li et al.
6,955,565 B2 10/2005 Lloyd et al.
6,957,982 B1 10/2005 Hyland et al.
6,966,797 B2 11/2005 Ko
6,976,870 B1 12/2005 Li
6,976,876 B1 12/2005 Su et al.
6,991,494 B1 1/2006 Spink, Jr.
6,997,747 B1 2/2006 Norte et al.
7,008,762 B2 3/2006 Zhang et al.
7,018,237 B2 3/2006 Zhan et al.
7,025,632 B2 4/2006 Hu et al.
7,029,331 B1 4/2006 Lai
7,033,219 B2 4/2006 Gordon et al.
7,037,136 B1 5/2006 Korsunsky et al.
7,037,137 B2 5/2006 Lee
7,044,790 B2 5/2006 Zhu et al.
7,044,791 B2 5/2006 Wang
7,052,321 B2 5/2006 Chang
7,052,322 B2 5/2006 Hu et al.
7,059,908 B2 6/2006 Yamaguchi
7,066,765 B2 6/2006 Togami et al.
7,074,082 B2 7/2006 Kerlin et al.
7,074,083 B2 7/2006 Hyland
7,074,084 B2 7/2006 Shuey et al.
7,074,085 B2 7/2006 Chen
7,077,707 B2 7/2006 Hyland et al.
7,083,468 B2 8/2006 Walker et al.
7,083,472 B2 8/2006 Gordon et al.
7,086,901 B2 8/2006 Zhang
7,086,902 B1 8/2006 Yang
7,090,534 B2 8/2006 Wu et al.
7,094,103 B2 8/2006 Lai
7,097,505 B1 8/2006 Shanahan et al.
7,097,507 B1 8/2006 Zhang et al.
7,102,082 B2 9/2006 Ortiz et al.
7,104,842 B1 9/2006 Huang et al.
7,121,890 B2 10/2006 Chang
7,128,607 B2 10/2006 Li
7,128,610 B1 10/2006 Chiang
7,140,918 B1 11/2006 Delaney et al.
7,147,511 B2 12/2006 Litz
7,147,513 B2 12/2006 Wada et al.
7,150,653 B1 12/2006 Mason
7,153,162 B2 12/2006 Mizumura et al.
7,160,153 B1 1/2007 Huang
7,165,995 B2 1/2007 Fukushima et al.
7,165,996 B1 1/2007 Kao
7,168,959 B2 1/2007 Kuo et al.
7,168,985 B1 1/2007 Zhang et al.
7,168,986 B1 1/2007 Peng
7,168,987 B1 1/2007 Morohoshi et al.
7,175,475 B2 2/2007 Hanley
7,178,230 B2 2/2007 Tsai
7,182,649 B2 * 2/2007 Caveney ..... H05K 1/0228 439/620.22
7,192,310 B1 3/2007 Chao et al.
7,211,739 B1 5/2007 Brigham, Jr. et al.
7,223,121 B2 5/2007 Moriyama et al.
7,223,125 B2 5/2007 Chen
7,229,317 B2 6/2007 Togami et al.
7,232,316 B2 6/2007 Chen
7,232,340 B2 6/2007 Hammond, Jr. et al.
7,238,048 B2 7/2007 Olson et al.
7,238,049 B1 7/2007 Wu
7,238,050 B2 7/2007 Sakakura et al.
7,241,157 B2 7/2007 Zhuang et al.
7,249,966 B2 7/2007 Long
7,249,974 B2 7/2007 Gordon et al.
7,252,549 B2 8/2007 Nishio et al.
7,258,574 B2 8/2007 Barringer et al.
7,261,592 B2 8/2007 Korsunsky et al.
7,264,508 B2 9/2007 Sakakura et al.
7,267,579 B1 9/2007 Wu
7,270,570 B1 9/2007 Hamner et al.
7,273,396 B2 9/2007 Itano et al.
7,278,885 B1 10/2007 Zhang
7,294,024 B2 11/2007 Hammond, Jr. et al.
7,306,487 B1 12/2007 Chang
7,309,238 B2 12/2007 Yang
7,311,556 B2 12/2007 Wan et al.
7,322,854 B2 1/2008 Long et al.
7,341,487 B2 3/2008 Wu
7,351,098 B2 4/2008 Gladd et al.
7,351,104 B2 4/2008 Neer et al.
7,351,105 B2 4/2008 Delaney et al.
7,357,673 B2 4/2008 Long
7,361,063 B2 4/2008 Mullin et al.
7,364,458 B1 4/2008 Ju
7,371,118 B2 5/2008 Wu
7,384,298 B2 6/2008 Caveney
7,387,536 B2 6/2008 Wang
7,390,220 B1 6/2008 Wu
7,404,724 B1 7/2008 Miller
7,404,739 B2 7/2008 Sheilds et al.
7,410,390 B2 8/2008 Watanabe et al.
7,416,449 B2 8/2008 Kuo et al.
7,422,481 B2 9/2008 Togami et al.
7,422,482 B2 9/2008 Wang
7,435,138 B2 10/2008 Liu et al.
7,435,139 B2 10/2008 Yang
7,438,596 B2 10/2008 Phillips
7,442,082 B2 10/2008 Ma
7,445,502 B2 11/2008 Zhang
7,445,505 B1 11/2008 Yi
7,445,506 B2 11/2008 Ma
7,455,554 B2 11/2008 Long
7,462,071 B1 12/2008 Wu
7,467,974 B2 12/2008 Zhang
7,470,150 B2 12/2008 Kuo et al.
7,473,130 B2 1/2009 Weber et al.
7,473,131 B2 1/2009 Dunwoody et al.
7,473,135 B1 1/2009 Guo et al.

(56) References Cited

U.S. PATENT DOCUMENTS 7,473,136 B2 1/2009 Hu et al.
7,473,139 B2 1/2009 Barringer et al.
7,479,036 B2 1/2009 Briant et al.
7,485,002 B2 2/2009 Nishide et al.
7,488,212 B2 2/2009 Chen
7,497,732 B2 3/2009 Yi
7,507,120 B1 3/2009 Bright et al.
7,510,438 B2 3/2009 Hammond, Jr. et al.
7,510,439 B2 3/2009 Gordon et al.
7,524,206 B2 4/2009 Gutierrez et al.
7,527,525 B2 5/2009 Long et al.
7,530,845 B1 5/2009 Yang
7,534,141 B1 5/2009 Wu
7,534,143 B1 5/2009 Tsao et al.
7,544,068 B2 6/2009 Glaab, III et al.
7,547,217 B1 6/2009 Lin
7,559,799 B2 7/2009 Ma
7,559,800 B2 7/2009 Wu
7,559,802 B2 7/2009 Hu et al.
7,563,125 B2 7/2009 Pepe et al.
7,563,136 B1 7/2009 Wu
7,566,245 B1 7/2009 McColloch
7,568,950 B2 8/2009 Belopolsky et al.
7,572,145 B1 8/2009 Wu
7,572,148 B1 8/2009 Pepe et al.
7,578,700 B2 8/2009 Xiong et al.
7,588,461 B2 9/2009 Tyler
7,597,590 B2 10/2009 McColloch
7,604,503 B2 10/2009 Hammond, Jr. et al.
7,607,947 B1 10/2009 Ho
7,611,358 B2 11/2009 Cox et al.
7,612,299 B2 11/2009 Chen
7,614,913 B2 11/2009 Ice
7,621,772 B1 11/2009 Tobey
7,625,235 B2 12/2009 Wu et al.
7,625,236 B1 12/2009 Wu
7,625,243 B2 12/2009 Chen et al.
7,632,145 B1 12/2009 Lin et al.
7,632,148 B1 12/2009 Kawamura et al.
7,641,515 B1 1/2010 Szczesny et al.
7,641,519 B1 1/2010 Chen
7,645,165 B2 1/2010 Wu et al.
7,648,390 B2 1/2010 Zhang et al.
7,651,342 B1 1/2010 Wu
7,651,372 B2 1/2010 Matsuzaki et al.
7,654,831 B1 2/2010 Wu
7,654,866 B2 2/2010 He et al.
7,666,031 B2 2/2010 Kumamoto et al.
7,670,179 B2 3/2010 Muller
7,677,926 B1 3/2010 Huang
7,682,195 B2 3/2010 Yuan et al.
7,695,318 B1 4/2010 Wang et al.
7,704,097 B1 4/2010 Phillips et al.
7,704,098 B2 4/2010 Lambie et al.
7,717,730 B2 5/2010 Wu
7,717,744 B2 5/2010 Ma
7,717,745 B2 5/2010 He et al.
7,722,392 B2 5/2010 Lee et al.
7,722,402 B2 5/2010 Pepe et al.
7,727,018 B2 6/2010 Bright et al.
7,727,019 B2 6/2010 Droesbeke et al.
7,731,535 B1 6/2010 Wan et al.
7,731,536 B2 6/2010 Okayasu
7,744,413 B2 6/2010 Ma
7,744,418 B2 6/2010 He et al.
7,748,997 B2 7/2010 Hamner et al.
7,753,689 B1 7/2010 Wu
7,753,732 B2 7/2010 Kameyama et al.
7,753,733 B2 7/2010 Kameyama et al.
7,753,734 B2 7/2010 Eckel et al.
7,758,380 B2 7/2010 Wang et al.
7,758,383 B1 7/2010 Chantrell et al.
7,762,840 B2 7/2010 Hamner et al.
7,762,844 B2 7/2010 Ice
7,766,688 B2 8/2010 Ferrus
7,771,230 B2 8/2010 Hammond, Jr. et al.
7,771,235 B2 8/2010 Kameyama
7,771,236 B2 8/2010 Koyama et al.
7,780,462 B2 8/2010 Consoli et al.
7,789,706 B2 9/2010 Chen et al.
7,794,277 B1 9/2010 Peng
7,794,279 B1 9/2010 Ye et al.
7,798,850 B2 9/2010 Sabo et al.
7,798,853 B2 9/2010 Shi et al.
7,811,127 B2 10/2010 Tsuzaki et al.
7,811,132 B2 10/2010 Carpenter et al.
7,811,133 B2 10/2010 Gray
7,823,281 B2 * 11/2010 Caveney ..... H05K 1/028 29/857
7,824,194 B2 11/2010 Suzuki et al.
7,824,219 B2 11/2010 Wang
7,833,056 B1 11/2010 Lee et al.
7,837,507 B1 11/2010 Yang et al.
7,845,961 B2 12/2010 Zhu et al.
7,845,975 B2 12/2010 Cheng et al.
7,854,630 B1 12/2010 Wang
7,857,662 B2 12/2010 Gillespie et al.
7,862,346 B1 1/2011 Wan et al.
7,862,377 B2 1/2011 Shiu et al.
7,862,378 B1 1/2011 Wan et al.
7,862,379 B2 1/2011 Annecke
7,871,297 B2 1/2011 Li
7,874,849 B2 1/2011 Sticker et al.
7,874,865 B2 1/2011 Tobey
7,874,877 B2 * 1/2011 Caveney ..... H01R 13/6658 439/676
7,878,855 B2 2/2011 Li
7,883,372 B1 2/2011 Sun et al.
7,887,370 B2 2/2011 Chen et al.
7,887,376 B1 2/2011 Zhang et al.
7,892,018 B1 2/2011 Tobey
7,892,027 B2 2/2011 Mao et al.
7,892,028 B2 2/2011 Wu
7,901,221 B1 3/2011 Li et al.
7,909,646 B2 3/2011 Feldman et al.
7,909,647 B2 3/2011 Kawaguchi et al.
7,909,654 B2 3/2011 He et al.
7,914,328 B2 3/2011 Tanaka et al.
7,922,533 B2 4/2011 Wang et al.
7,922,534 B2 4/2011 Lin et al.
7,927,145 B1 4/2011 Chang
7,928,324 B2 4/2011 Moore
7,938,683 B2 5/2011 Nagata
7,942,704 B2 5/2011 Ko et al.
7,946,893 B2 5/2011 Chen et al.
7,955,132 B2 6/2011 Luo
7,955,137 B2 6/2011 Ko et al.
7,959,467 B2 6/2011 Sasser et al.
7,959,469 B2 6/2011 Kawamura et al.
7,967,644 B2 * 6/2011 Pepe ..... H01R 13/02 439/676
7,972,150 B1 7/2011 Lin
7,997,927 B2 8/2011 Wan et al.
8,002,582 B2 8/2011 Fakhri et al.
8,007,317 B2 8/2011 Su et al.
8,007,318 B1 8/2011 Dunwoody et al.
8,011,958 B1 9/2011 Guo et al.
8,011,959 B1 9/2011 Tsai et al.
8,021,188 B1 9/2011 Ma et al.
8,029,319 B2 10/2011 Kameyama et al.
8,038,475 B2 10/2011 Kameyama et al.
8,038,480 B2 10/2011 Wei
8,052,469 B2 11/2011 Mao et al.
8,052,470 B1 11/2011 Lin
8,057,258 B2 11/2011 Kawaguchi et al.
8,062,066 B1 11/2011 Hsieh
8,062,067 B2 11/2011 Shiu et al.
8,070,517 B2 12/2011 Xiong et al.
8,075,341 B2 12/2011 Su et al.
8,077,887 B2 12/2011 Akino
8,079,874 B2 12/2011 Lee et al.
8,083,530 B2 12/2011 Kobayashi
8,096,833 B2 1/2012 Tobey
8,096,834 B2 1/2012 Lai et al.

(56) References Cited

U.S. PATENT DOCUMENTS 8,100,718 B2 1/2012 Li et al.
8,100,720 B2 1/2012 Lin et al.
8,105,110 B2 1/2012 Hsia et al.
8,109,791 B2 2/2012 Kameyama et al.
8,113,865 B1 2/2012 Yang et al.
8,113,882 B1 2/2012 Chen
8,123,559 B2 2/2012 Brown et al.
8,123,560 B2 2/2012 McAlonis et al.
8,123,562 B2 2/2012 Zhou et al.
8,137,131 B2 3/2012 Wang et al.
8,142,209 B2 3/2012 Zhu et al.
8,147,272 B2 4/2012 Rhein
8,152,569 B2 4/2012 Chen et al.
8,157,593 B1 4/2012 Sim et al.
8,157,599 B2 4/2012 Wei
8,167,651 B2 5/2012 Glover et al.
8,167,661 B2 5/2012 Straka et al.
8,182,287 B2 5/2012 Kondo
8,182,288 B1 5/2012 Lin
8,182,290 B2 5/2012 Fonteneau et al.
8,182,291 B2 5/2012 Tsou
8,183,470 B2 5/2012 Zhang et al.
8,187,033 B2 5/2012 Feldman et al.
8,188,381 B2 5/2012 Chan
8,192,231 B2 6/2012 De Blieck et al.
8,202,120 B2 6/2012 Ko
8,202,122 B2 6/2012 Wu
8,202,126 B2 6/2012 Lim
8,203,084 B2 6/2012 Wertz, Jr. et al.
8,206,161 B1 6/2012 Lan et al.
8,215,989 B2 7/2012 Tamm et al.
8,221,163 B2 7/2012 Kawakami et al.
8,251,735 B2 8/2012 Wu
8,251,746 B2 8/2012 Zhang et al.
8,251,748 B2 8/2012 Tyler et al.
8,257,114 B2 9/2012 Wang et al.
8,259,457 B2 9/2012 Mills
8,262,411 B2 9/2012 Kondo
8,267,703 B2 9/2012 Yao et al.
8,277,252 B2 10/2012 Fogg et al.
8,292,637 B2 10/2012 Wu
8,298,014 B2 10/2012 Li et al.
8,298,016 B2 10/2012 Lai et al.
8,303,343 B2 11/2012 Nagata
8,317,544 B2 11/2012 Matsuoka et al.
8,328,579 B2 12/2012 Sasaki et al.
8,333,613 B2 12/2012 De Chazal et al.
8,333,616 B2 12/2012 Su et al.
8,337,238 B2 12/2012 Tobey et al.
8,337,246 B2 12/2012 Zhang
8,342,881 B2 1/2013 Lang et al.
8,342,882 B2 1/2013 Zhang et al.
8,348,699 B2 1/2013 Nagawatari et al.
8,348,701 B1 1/2013 Lan et al.
8,353,721 B2 1/2013 Deimel et al.
8,353,722 B1 1/2013 Lan et al.
8,360,808 B2 1/2013 Tsuchiya
8,366,486 B1 2/2013 Lan et al.
8,371,875 B2 2/2013 Gailus
8,376,779 B2 2/2013 Metral et al.
8,382,519 B2 2/2013 Lin et al.
8,382,523 B1 2/2013 Lazaro, Jr.
8,388,378 B2 3/2013 Ratzlaff et al.
8,388,379 B2 3/2013 Sasaki et al.
8,398,434 B2 3/2013 Davis et al.
8,403,704 B2 3/2013 Marchetti et al.
8,414,331 B2 4/2013 Chang
8,425,240 B2 4/2013 Lee et al.
8,425,257 B2 4/2013 Gao et al.
8,430,691 B2 4/2013 Davis
8,435,075 B2 5/2013 Lim et al.
8,435,082 B2 * 5/2013 Bopp ..... H01R 13/6466 439/676
8,439,705 B2 5/2013 Zhang
8,439,706 B2 5/2013 Sytsma et al.
8,444,434 B2 5/2013 Davis et al.
8,444,437 B2 5/2013 Szczesny et al.
8,449,329 B1 5/2013 Schroll
8,449,330 B1 5/2013 Schroll et al.
8,449,331 B2 5/2013 Phillips et al.
8,460,033 B2 6/2013 Regnier et al.
8,469,744 B2 6/2013 Nichols et al.
8,475,208 B2 7/2013 Simpson et al.
8,485,844 B2 7/2013 Omae et al.
8,500,490 B2 8/2013 Tsou
8,500,493 B2 8/2013 Liu et al.
8,506,332 B2 8/2013 Sommers et al.
8,512,076 B2 8/2013 Zhang et al.
8,517,765 B2 8/2013 Schroll et al.
8,535,069 B2 9/2013 Zhang
8,535,094 B2 9/2013 Youn et al.
8,545,267 B2 10/2013 Fogg et al.
8,545,268 B2 10/2013 Fogg et al.
8,562,376 B2 10/2013 Chen
8,568,173 B2 10/2013 Wu
8,574,007 B2 11/2013 Smith et al.
8,579,660 B2 11/2013 Chow et al.
8,579,661 B2 11/2013 Zhang
8,632,362 B2 1/2014 Straka
8,784,118 B2 * 7/2014 Ihara ..... H05K 7/1069 439/66
8,801,455 B2 8/2014 Garcia
9,368,892 B2 * 6/2016 Kondo ..... H05K 1/147
9,680,265 B2 * 6/2017 Park ..... H01R 24/60
9,847,607 B2 12/2017 Bopp et al.
2001/0006860 A1 7/2001 Nimura
2001/0018293 A1 8/2001 Van Zanten
2001/0049209 A1 12/2001 Casey et al.
2002/0025722 A1 2/2002 Inagawa et al.
2002/0039860 A1 4/2002 Shirai et al.
2002/0098737 A1 7/2002 Koide et al.
2002/0119702 A1 8/2002 Chen
2002/0132524 A1 9/2002 Festag et al.
2002/0142656 A1 10/2002 Chang
2003/0022555 A1 1/2003 Vicich et al.
2003/0054692 A1 3/2003 Pocrass
2003/0060084 A1 3/2003 Aoki
2003/0092319 A1 5/2003 Hung
2003/0129877 A1 7/2003 Chen
2003/0176111 A1 9/2003 Iida et al.
2003/0203675 A1 10/2003 McDougall
2004/0009704 A1 1/2004 Hsiao et al.
2004/0097136 A1 5/2004 Flickinger et al.
2004/0235349 A1 11/2004 Tanaka
2005/0026500 A1 2/2005 Ji et al.
2005/0026502 A1 2/2005 Wan et al.
2005/0042922 A1 2/2005 Haller et al.
2005/0142942 A1 6/2005 Hayashi
2005/0221673 A1 10/2005 Myer et al.
2005/0227537 A1 10/2005 Peng
2006/0040554 A1 2/2006 Liu
2006/0134995 A1 6/2006 Bolouri-Saransar et al.
2006/0166556 A1 7/2006 Hirata
2007/0026736 A1 2/2007 Itano et al.
2007/0087629 A1 4/2007 Liang
2007/0099503 A1 5/2007 Konz
2007/0117458 A1 5/2007 Winker et al.
2007/0128937 A1 6/2007 Long et al.
2007/0173120 A1 7/2007 Caveney et al.
2007/0254517 A1 11/2007 Olson et al.
2008/0014797 A1 1/2008 Yang
2008/0045083 A1 2/2008 Metral et al.
2008/0096422 A1 4/2008 Liao et al.
2008/0102698 A1 5/2008 Chen
2008/0139048 A1 6/2008 Tai et al.
2008/0207052 A1 8/2008 Zhang
2008/0207055 A1 8/2008 Buttner
2008/0214049 A1 9/2008 Gump et al.
2008/0214050 A1 9/2008 Ishizuka et al.
2008/0233799 A1 9/2008 Winker et al.
2008/0242149 A1 10/2008 Konno et al.
2008/0254685 A1 10/2008 Murr et al.
2008/0318476 A1 12/2008 Weber et al.
2009/0023336 A1 1/2009 Kondo et al.

(56) References Cited

U.S. PATENT DOCUMENTS

| | | | |
|---|---|---|---|
| 2009/0023337 | A1 | 1/2009 | Chang |
| 2009/0023338 | A1 | 1/2009 | He et al. |
| 2009/0061683 | A1 | 3/2009 | Ball et al. |
| 2009/0068885 | A1 | 3/2009 | He |
| 2009/0111324 | A1 | 4/2009 | Hughes et al. |
| 2009/0124124 | A1 | 5/2009 | Huang et al. |
| 2009/0124136 | A1 | 5/2009 | Pepe et al. |
| 2009/0176408 | A1 | 7/2009 | Wu |
| 2009/0203256 | A1 | 8/2009 | Mathews |
| 2009/0215290 | A1 | 8/2009 | Zhu et al. |
| 2009/0215315 | A1 | 8/2009 | Cheng |
| 2009/0318023 | A1 | 12/2009 | Block et al. |
| 2010/0003852 | A1 | 1/2010 | Myer et al. |
| 2010/0040332 | A1 | 2/2010 | Van Den Meersschaut et al. |
| 2010/0041257 | A1 | 2/2010 | Beck et al. |
| 2010/0041274 | A1 | 2/2010 | Marti et al. |
| 2010/0048058 | A1 | 2/2010 | Morgan et al. |
| 2010/0087095 | A1 | 4/2010 | Hammond, Jr. et al. |
| 2010/0099300 | A1 | 4/2010 | Hsieh |
| 2010/0099301 | A1 | 4/2010 | Mulfinger et al. |
| 2010/0112859 | A1 | 5/2010 | Olawsky et al. |
| 2010/0112862 | A1 | 5/2010 | Chiu et al. |
| 2010/0151707 | A1 | 6/2010 | AbuGhazaleh et al. |
| 2010/0151732 | A1 | 6/2010 | Xu et al. |
| 2010/0167584 | A1 | 7/2010 | He |
| 2010/0178804 | A1 | 7/2010 | Long |
| 2010/0184329 | A1 | 7/2010 | Hou et al. |
| 2010/0210142 | A1 | 8/2010 | McGrath et al. |
| 2010/0227504 | A1 | 9/2010 | Wang et al. |
| 2010/0233891 | A1 | 9/2010 | Broeksteeg et al. |
| 2010/0267255 | A1 | 10/2010 | Mo |
| 2010/0330839 | A1 | 12/2010 | Su et al. |
| 2011/0009001 | A1 | 1/2011 | Chen et al. |
| 2011/0034067 | A1 | 2/2011 | Caveney et al. |
| 2011/0104945 | A1 | 5/2011 | Gao et al. |
| 2011/0151708 | A1 | 6/2011 | Kaneko et al. |
| 2011/0159732 | A1 | 6/2011 | Kondo et al. |
| 2011/0195592 | A1 | 8/2011 | McGrath et al. |
| 2011/0195593 | A1 | 8/2011 | McGrath et al. |
| 2011/0223805 | A1 | 9/2011 | Regnier et al. |
| 2011/0269341 | A1 | 11/2011 | He et al. |
| 2011/0281464 | A1 | 11/2011 | Hou |
| 2011/0281465 | A1 | 11/2011 | Hou |
| 2011/0306238 | A1 | 12/2011 | Yu et al. |
| 2011/0306239 | A1 | 12/2011 | Zhang et al. |
| 2011/0312212 | A1 | 12/2011 | Machado et al. |
| 2011/0318963 | A1 | 12/2011 | Kamoya et al. |
| 2012/0009811 | A1 | 1/2012 | He et al. |
| 2012/0015554 | A1 | 1/2012 | Tseng |
| 2012/0021636 | A1 | 1/2012 | Debenedictis et al. |
| 2012/0028501 | A1 | 2/2012 | Cheng |
| 2012/0058670 | A1 | 3/2012 | Regnier et al. |
| 2012/0129393 | A1 | 5/2012 | Peng |
| 2012/0129398 | A1 | 5/2012 | Droesbeke |
| 2012/0136929 | A1 | 5/2012 | Li et al. |
| 2012/0184139 | A1 | 7/2012 | Long |
| 2012/0196478 | A1 | 8/2012 | Zhang et al. |
| 2012/0196479 | A1 | 8/2012 | Chow et al. |
| 2012/0202380 | A1 | 8/2012 | Lappoehn |
| 2012/0214343 | A1 | 8/2012 | Buck et al. |
| 2012/0225583 | A1 | 9/2012 | Kamarauskas et al. |
| 2012/0250911 | A1 | 10/2012 | Tamm et al. |
| 2012/0252271 | A1 | 10/2012 | Pan |
| 2012/0276757 | A1 | 11/2012 | Matsuoka |
| 2012/0276776 | A1 | 11/2012 | Becker et al. |
| 2012/0282809 | A1 | 11/2012 | Banakis et al. |
| 2012/0295482 | A1 | 11/2012 | Wu |
| 2012/0302096 | A1 | 11/2012 | Ellison |
| 2012/0322306 | A1 | 12/2012 | Tai et al. |
| 2012/0329321 | A1 | 12/2012 | Scritzky et al. |
| 2013/0017724 | A1 | 1/2013 | Liu |
| 2013/0023132 | A1 | 1/2013 | Mills |
| 2013/0023154 | A1 | 1/2013 | Ii |
| 2013/0040491 | A1 | 2/2013 | Wu |
| 2013/0040492 | A1 | 2/2013 | Wu |
| 2013/0040493 | A1 | 2/2013 | Wu |
| 2013/0065437 | A1 | 3/2013 | Scritzky et al. |
| 2013/0065442 | A1 | 3/2013 | Nagata et al. |
| 2013/0072063 | A1 | 3/2013 | Qiao |
| 2013/0078871 | A1 | 3/2013 | Milbrand, Jr. |
| 2013/0084741 | A1 | 4/2013 | Pabst et al. |
| 2013/0084745 | A1 | 4/2013 | Siahaan et al. |
| 2013/0084746 | A1 | 4/2013 | Siahaan et al. |
| 2013/0102192 | A1 | 4/2013 | Davis |
| 2013/0130548 | A1 | 5/2013 | Wu et al. |
| 2013/0130549 | A1 | 5/2013 | Wu et al. |
| 2013/0149899 | A1 | 6/2013 | Schroll et al. |
| 2013/0149900 | A1 | 6/2013 | Zhang et al. |
| 2013/0149901 | A1 | 6/2013 | Lee et al. |
| 2013/0149902 | A1 | 6/2013 | Tsuchiya |
| 2013/0189876 | A1 | 7/2013 | Lang et al. |
| 2013/0189877 | A1 | 7/2013 | Lan et al. |
| 2013/0210273 | A1 | 8/2013 | Wu et al. |
| 2013/0224998 | A1 | 8/2013 | Feldstein et al. |
| 2013/0231005 | A1 | 9/2013 | Qiao et al. |
| 2013/0280955 | A1 | 10/2013 | Alden, III et al. |
| 2013/0288522 | A1 | 10/2013 | Ii |
| 2013/0288523 | A1 | 10/2013 | Ii |
| 2013/0288526 | A1 | 10/2013 | Rascon et al. |

FOREIGN PATENT DOCUMENTS

| | | | |
|---|---|---|---|
| EP | 1 093 190 | A1 | 4/2001 |
| EP | 0 800 238 | B1 | 10/2001 |
| KR | 10-0833802 | B1 | 5/2008 |
| WO | WO 02/15339 | A1 | 2/2002 |

OTHER PUBLICATIONS

Extended European Search Report for European Application No. 15783879.8 dated Sep. 29, 2017, 9 pages.

* cited by examiner

ELECTRICAL CONNECTOR WITH SHIELD CAP AND SHIELDED TERMINALS

CROSS REFERENCE TO RELATED APPLICATION

This application is a divisional of U.S. patent application Ser. No. 14/694,393 filed on Apr. 23, 2015, which claims the benefit of provisional application Ser. No. 61/982,958, filed Apr. 23, 2014, which is incorporated herein by reference in its entirety.

BACKGROUND

Electrical connectors, such as modular jacks and modular plugs, are commonly used in telecommunications systems. Such connectors may be used to provide interfaces between successive runs of cable in telecommunications systems and between cables and electronic devices. In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of compatibility.

To promote high circuit density, communications networks typically include a plurality of electrical connectors that bring transmission signals in close proximity to one another. For example, the contacts of multiple sets of jacks and plugs are positioned fairly closely to one another. However, such a high density configuration is particularly susceptible to alien crosstalk inference.

Alien crosstalk is electromagnetic noise that can occur in a cable that runs alongside one or more other signal-carrying cables or in a connector that is positioned proximate to another connector. The term "alien" arises from the fact that this form of crosstalk occurs between different cables in a bundle or different connectors in a group, rather than between individual wires or circuits within a single cable or connector. Alien crosstalk affects the performance of a communications system by reducing the signal-to-noise ratio.

Various arrangements are introduced to reduce alien crosstalk between adjacent connectors. One possible solution is to separate the cables and/or connectors from each other by a predetermined distance so that the likelihood of alien crosstalk is minimized. This solution, however, reduces the density of cables and/or connectors that may be used per unit of area.

The telecommunications industry is constantly striving toward larger signal frequency ranges. As transmission frequency ranges widen, crosstalk becomes more problematic. Thus, there is a need for further development of electrical connectors with high efficiency in reducing the crosstalk between adjacent connectors.

SUMMARY

This disclosure is generally directed to electrical connectors. In one possible configuration and by non-limiting example, the electrical connectors are jack assemblies configured to reduce crosstalk between adjacent electrical connectors. In another possible configuration and by non-limiting example, the electrical connectors include wire termination conductors with a shielding layer configured to reduce crosstalk between adjacent wire termination conductors and/or adjacent electrical connectors. Various aspects are described in this disclosure, which include, but are not limited to, the following aspects.

One aspect of the present disclosure relates to an electrical connector including a connector housing and a shield cap. The connector housing has front and rear ends and a cavity opened at the front end for receiving a plug. The connector further includes one or more insulation displacement contacts supported by the connector housing and extending from the connector housing at the rear end. The shield cap may be mounted to the connector housing at the rear end. The shield cap may include a body portion configured to engage the connector housing, and opposite shield plates connected to opposite sides of the body and configured to at least partially cover the insulation displacement contact.

Another aspect of the present disclosure is directed to a shield cap configured to be mounted to an electrical connector. The shield cap may include a body portion and opposite shield plates. The body portion is configured to engage the electrical connector. The body portion may be formed from a non-conductive material. The opposite shield plates may be connected to opposite sides of the body portion and configured to at least partially cover one or more insulation displacement contacts exposed from the electrical connector.

Still another aspect of the present disclosure relates to a jack assembly for terminating a plurality of line wires of a communications cable. The jack assembly may include a dielectric jack housing and a shield cap. The jack housing has front and rear ends, and includes a cavity opened at the front end for receiving a plug. The jack housing may further include a contact subassembly joined to the rear end. The contact subassembly may include a plurality of arms extending from the contact subassembly against the rear end of the jack housing and spaced part to define a plurality of conductor channels. A plurality of insulation displacement contacts are provided in the contact subassembly so that each insulation displacement contact is held within each of the plurality of conductor channels. The jack housing also includes a plurality of electrical contacts configured and positioned in the cavity for engaging corresponding contacts of the plug. The jack housing may include a circuit board configured to electrically connect the plurality of electrical contacts and the plurality of insulation displacement contacts. The shield cap is configured to be mounted to the jack housing at the rear end to cover at least partially the contact subassembly. The shield cap may include a body portion, a cable sleeve, opposite sidewalls, and opposite shield plates. The body portion has an inner surface and an outer surface and is made from a non-conductive material. The cable sleeve extends outwardly from the outer surface of the body and configured to receive a cable having a plurality of conductors. The cable is inserted through the cable sleeve so that each of the plurality of conductors of the cable is connected to each of the plurality of insulation displacement contacts. The opposite sidewalls may be configured to extend from the inner surface and have one or more latch projections configured to engage the jack housing. The opposite shield plates may be configured to extend from the inner surface so as to at least partially cover the contact subassembly. The opposite shield plates are made from a conductive material.

Still another aspect of the present disclosure relates to an electrical connector. The electrical connector includes a connector housing, an electrical contact, and a wire termination conductor. The connector housing has front and rear ends and receives a plug at the front end. The electrical contact engages a corresponding electrical contact of the plug. The wire termination conductor is connected to the electrical contact and extends from the connector housing at the rear end. The wire termination conductor is configured to be connected to a wire conductor of a cable. The wire termination conductor is at least partially coated with a shielding layer. The shielding layer is adapted for reducing crosstalk between adjacent electrical connectors, and between adjacent wire termination conductors.

Still another aspect of the present disclosure is a wire termination conductor used for an electrical connector. The wire termination conductor includes a support head supported by the electrical connector, and a wire engaging body extending from the electrical connector and connected to a wire conductor of a cable. The wire engaging body is at least partially coated with a shielding layer. The wire engaging body has a first surface, a second surface opposite to the first surface, and a third surface extending between the first and second surfaces. The wire contact portion may be provided on the third surface. The shielding layer may be coated on the first and second surfaces, but not on the third surface.

The shielding layer may include a first layer and a second layer formed above the second layer. The first layer may be formed with a dielectric material, and the second layer may be formed with a conductive material. The dielectric material may be a polymer. The conductive material may be a conductive ink, such as a silver ink.

Still another aspect of the present disclosure is directed to a method of forming a shielding layer on a wire termination conductor used for an electrical connector. The method may include forming a first layer on at least a portion of the wire termination conductor, and forming a second layer on at least a portion of the first layer. The first layer may include a dielectric material, and the second layer may include a conductive material.

DETAILED DESCRIPTION

Figure 1:
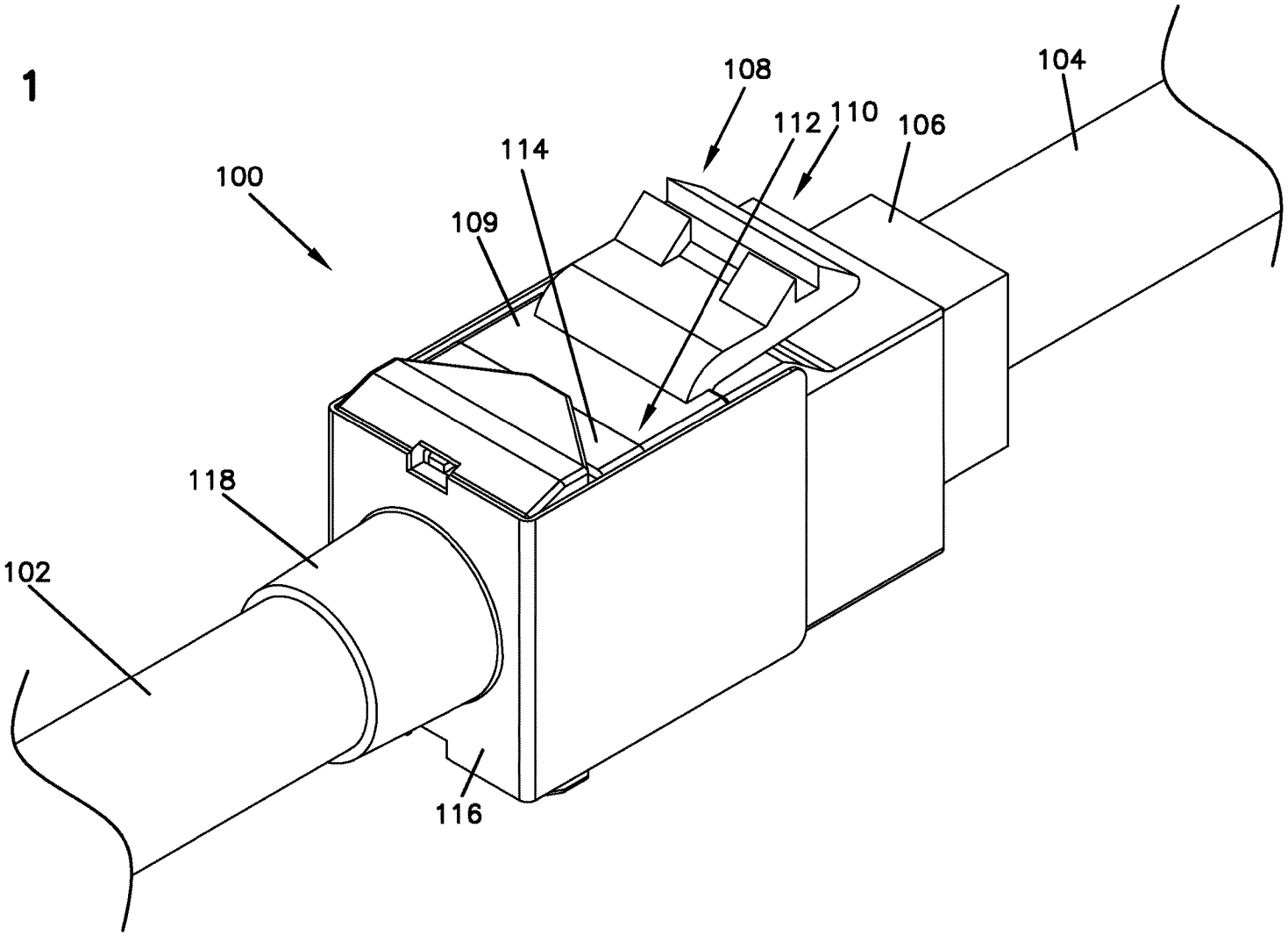
FIG. 1 is a rear perspective view of an exemplary electrical connector assembly.

FIG. 1 is a rear perspective view of an exemplary electrical connector assembly 100. The connector assembly 100 includes a plug 106 and a jack assembly 108. The plug 106 is connected to the jack assembly 108 for transmitting high speed electronic signals between multi-conductor cable 102 and multi-conductor cable 104. In some example, the plug 106 is an RJ-45 type. However, the plug 106 can be of any type or variation. The multi-conductor cables 102 and 104 can be twisted-pair cables having a plurality of insulated wire conductors 190 (FIG. 2) running throughout the corresponding cable. In this disclosure, the term "conductive," or other similar phrase, is used to refer to electrical conductivity, and thus can be interchangeably used with "electrically conductive."

In some examples, the jack assembly 108 includes a jack housing 109, a contact subassembly 114, and a shield cap 116. The jack housing 109 has a front end 110 and a rear end 112. The plug 106 is received to the front end 110, and the contact subassembly 114 is coupled to the rear end 112. The shield cap 116 is connected to the jack housing 109 or the contact subassembly 114 and configured to at least partially cover the contact subassembly 114 and/or electrical components exposed therefrom. In other examples, the jack housing 109 and the contact subassembly 114 are integrally formed. It is noted that the electrical connector assembly 100 as shown in FIG. 1 is only a non-limiting example and many other variations and types of connectors or connector assemblies can be used in accordance with the principles of the present disclosure.

The jack housing 109 can be fabricated from a non-conductive material or dielectric material. In other examples, the jack housing 109 is made from a non-conductive material having conductive particles dispersed therein. The conductive particles form a conductive network that facilitates providing EMI/RFI shielding for the electrical connector assembly 100. As such, the jack housing 109 is adapted to avoid formation of a conductive path. More specifically, the jack housing 109 may be configured to avoid forming a conductive path with an electrical contact 134 (FIG. 2).

In some examples, the contact subassembly 114 is fabricated from a non-conductive material or dielectric material. In other examples, the contact subassembly 114 is made from a non-conductive material having conductive particles dispersed therein. The conductive particles form a conductive network that facilitates providing EMI/RFI shielding for the electrical connector assembly 100.

As discussed in further detail below, the shield cap 116 provides shield plates 215 and 217 (FIGS. 3 and 4) for reducing alien crosstalk between adjacent electrical connector assemblies. Examples of materials used to make the shield cap 116 are described below in further detail.

Figure 2:
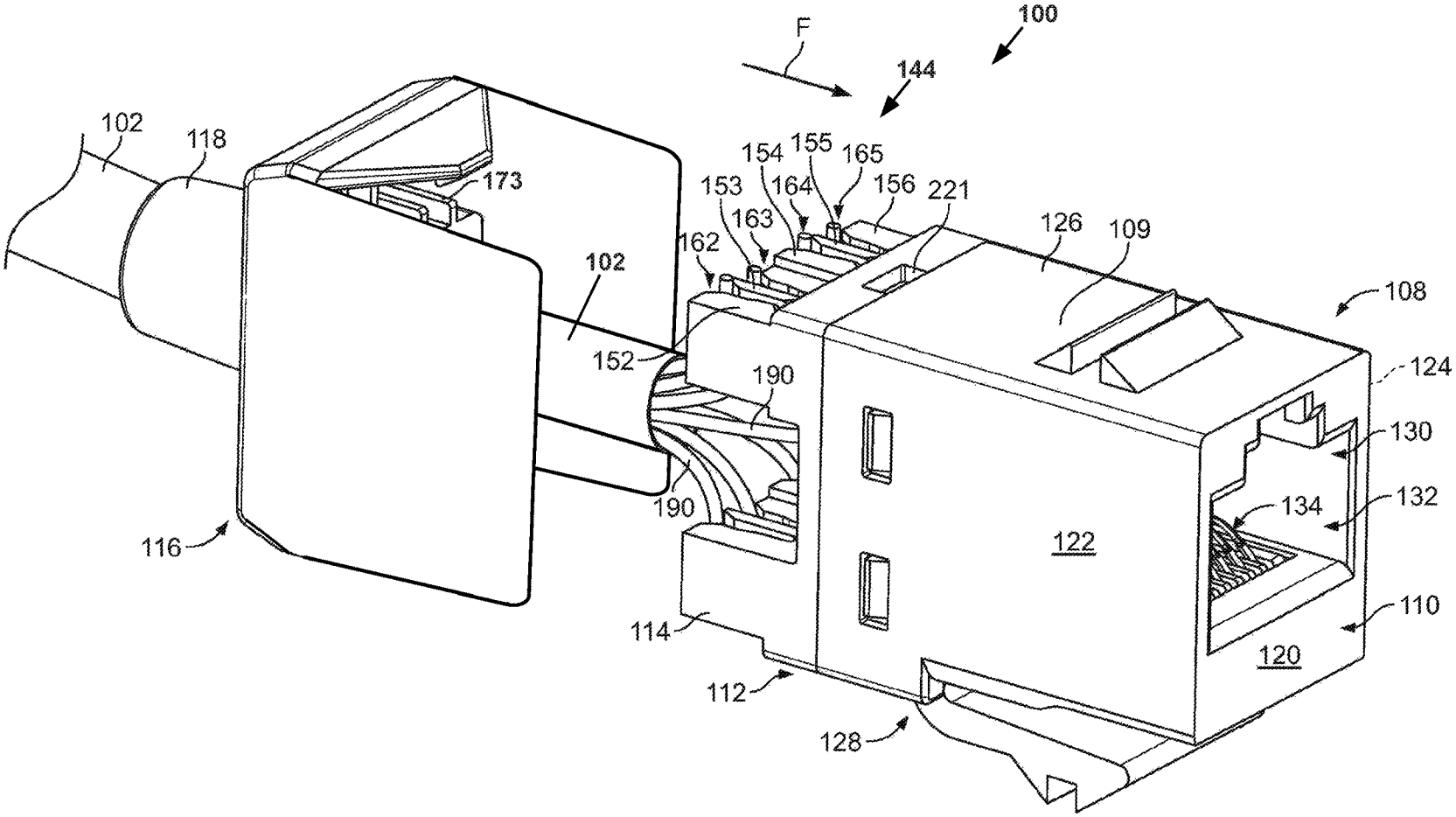
FIG. 2 is a front perspective view of a jack assembly of FIG. 1 before a shield cap engages a contact sub-assembly.

FIG. 2 is a front perspective view of the jack assembly 108 of FIG. 1 before the shield cap 116 engages the contact sub-assembly 114. As described above, the jack assembly 108 includes the jack housing 109, the contact subassembly 114, and the shield cap 116.

The jack housing 109 has a substantially rectangular shape and includes a front face 120, opposite sides 122 and 124, a top side 126, and a bottom side 128. The front face 120 is arranged at the front end 110 of the jack housing 109. The opposite sides 122 and 124, the top side 126, and the bottom side 128 extend between the front end 110 and the rear end 112 of the jack housing 109. The front face 120 forms an opening 130 that leads to a cavity 132 configured to receive the plug 106 (FIG. 1). The cavity 132 includes an array of electrical contacts 134 that extend through the jack housing 109 from the front end 110 to the rear end 112 and terminate at a corresponding wire termination conductor 180 (FIG. 3) on the contact subassembly 114. In this disclosure, the wire termination conductors 180 are depicted as insulation displacement contacts (IDC's) but could be other types of wire termination conductors such as wire wraps or pins. In certain examples, the arrangement of the electrical contacts 134 may be at least partially determined by industry standards, such as, but not limited to, International Electrotechnical Commission (IEC) 60603-7 or Electronics Industries Alliance/Telecommunications Industry Association (EIA/TIA)-568.

The contact subassembly 114 is configured to provide a plurality of insulation displacement contacts 180 that is electrically connected to a plurality of conductors 190 (FIG. 1) stripped at the end of the cable 102. The contact subassembly 114 is described in further detail with reference to FIG. 3.

The shield cap 116 operates to at least partially cover the contact subassembly 114 (and/or electrical components exposed therefrom) for crosstalk shielding and pass the cable 102 therethrough. In some examples, the shield cap 116 has a cable sleeve 118 extending axially in a rear direction. The cable sleeve 118 is configured to receive and provide strain relief for the cable 102 when the cable 102 is engaged with the contact sub-assembly 114. The cable sleeve 118 also operates as a bend limiter for the cable 102. In order to connect the cable 102 to the jack assembly 108, a stripped end of the cable 102 is first inserted through the cable sleeve 118 and advanced toward the contact subassembly 114. In some examples, the cable sleeve 118 is shaped as a truncated cone.

Figure 3:
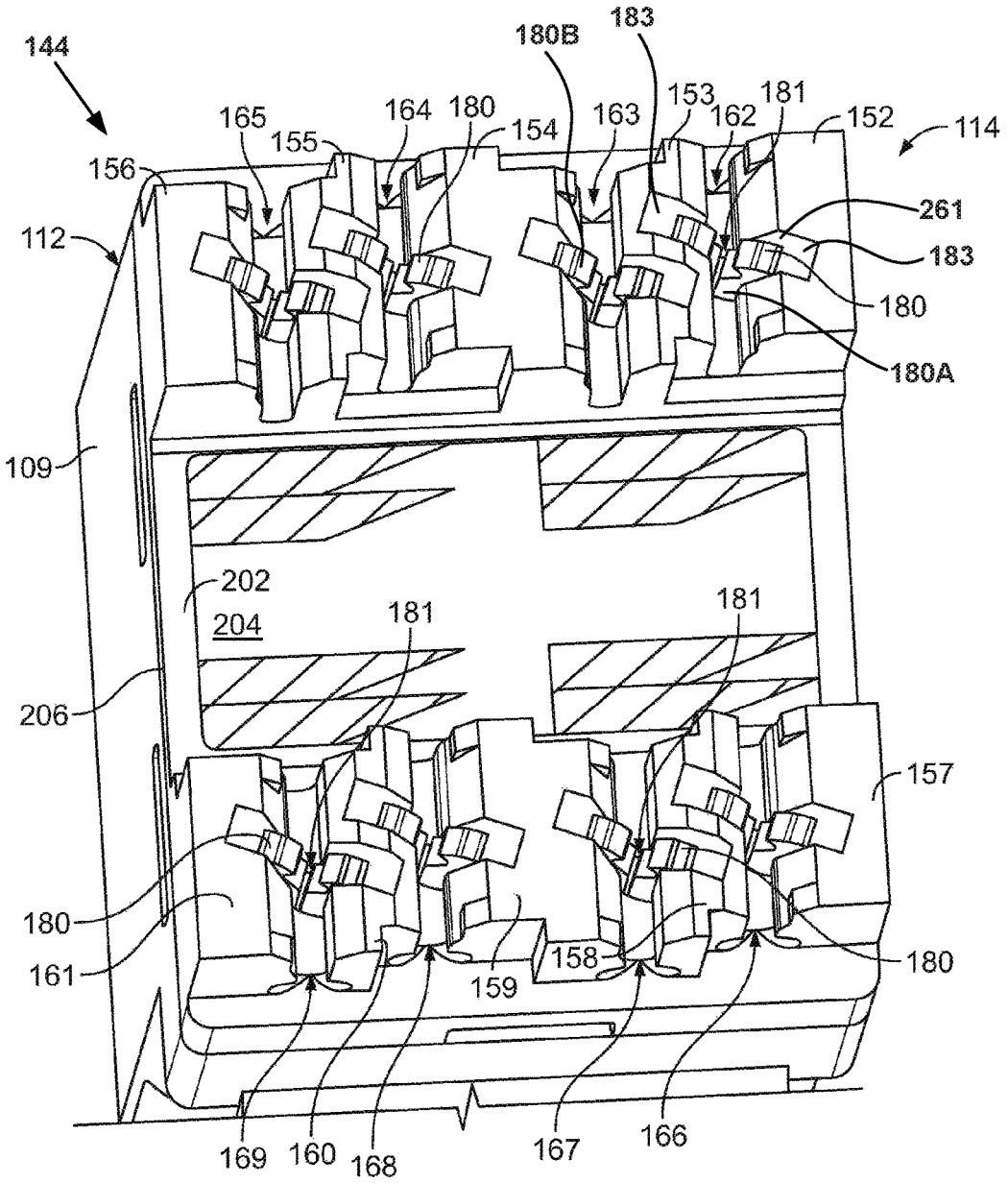
FIG. 3 is a front perspective view of the contact subassembly of FIG. 2.

FIG. 3 is a front perspective view of the contact subassembly 114 of FIG. 2. The contact subassembly 114 includes a back covering 202 having an outer surface 204 and a covering edge 206 that defines a perimeter of the back covering 202. The back covering 202 encloses and holds a circuit board 262 (FIG. 11) within the jack housing 109. The circuit board 262 is configured to define circuit paths that extend from the plurality of electrical contacts 134 to the plurality of insulation displacement contacts 180, thereby electrically connecting the electrical contacts 134 and the insulation displacement contacts 180.

In some examples, the contact subassembly 114 includes a plurality of arms 152-161 that project axially outward away from the outer surface 204 of the contact subassembly 114, and thus from the rear end 112 of the jack housing 109. The plurality of arms 152-161 extend at an angle that is substantially perpendicular to the outer surface 204. The arms 152-161 can be integrally formed with the contact subassembly 114.

The plurality of arms 152-161 define a plurality of conductor channels 162-169 that is configured to accommodate the insulation displacement contacts 180 therein. In particular, the arms 152 and 153 define the conductor channel 162 therebetween; the arms 153 and 154 define the conductor channel 163 therebetween; the arms 154 and 155 define the conductor channel 164 therebetween; the arms 155 and 156 define the conductor channel 165 therebetween; the arms 157 and 158 define the conductor channel 166 therebetween; the arms 158 and 159 define the conductor channel 167 therebetween; the arms 159 and 160 define the conductor channel 168 therebetween; and the arms 160 and 161 define the conductor channel 169 therebetween.

The contact subassembly 114 includes a plurality of insulation displacement contacts (IDC's) 180 accommodated within the conductor channels 162-169, respectively. In particular, each IDC 180 has a slot 181 configured to hold a conductor 190 (FIG. 2) when the electrical connector assembly 100 is in operation. The slot 181 of each IDC 180 is oriented and rests within the corresponding conductor channel 162-169 so that the slot 181 can receive the conductor 190.

For example, the arms 152 and 153 are configured to surround the IDC 180A and the arms 153 and 154 are configured to surround the IDC 180B. Each arm 152-154 includes a cut-out 183 for receiving a portion of the IDC 180. The adjacent cut-outs 183 form an IDC channel 261 that intersects a corresponding conductor channel 162-169. In some examples, when the IDC channel 261 and the corresponding conductor channel 162-169 form an angle less than or greater than 90 degree, the IDC's 180A and 180B can be positioned closer to each other to increase density of IDC's 180 used by the jack assembly 108. Although the foregoing description relates specifically to the arms 152-154 and the conductor channel 162 and 163, the description can be similarly be applied to the arms 155-161 and the channels 164-169.

In some examples, the contact subassembly 114 includes engaging grooves 221 (FIG. 2) for engaging corresponding latch projections 218 and 220 of the shield cap 116. As described below, the shield cap 116 is configured to cover at least partially the contact subassembly 114 and assist each wire conductor of the cable 190 to engage the slot 181 of each IDC 180 when assembling the shield cap 116 to the contact subassembly 114. The structure of the contact subassembly 114 is disclosed in further detail by U.S. Pat. No. 7,563,125, entitled "Jack Assembly for Reducing Crosstalk," to Paul John Pepe, et al. The entirety of the patent is herein incorporated by reference.

Figure 4:
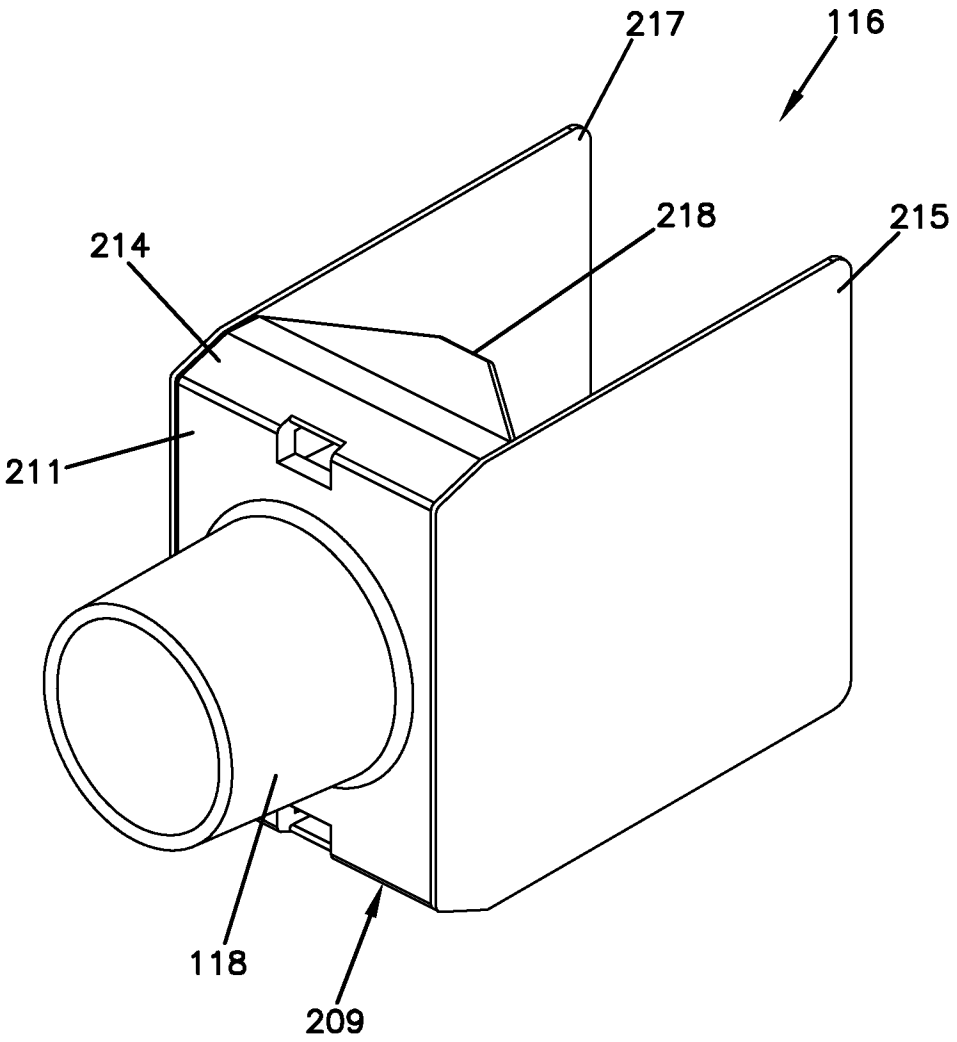
FIG. 4 is a perspective view of an exemplary shield cap of FIGS. 1 and 2.
Figure 5:
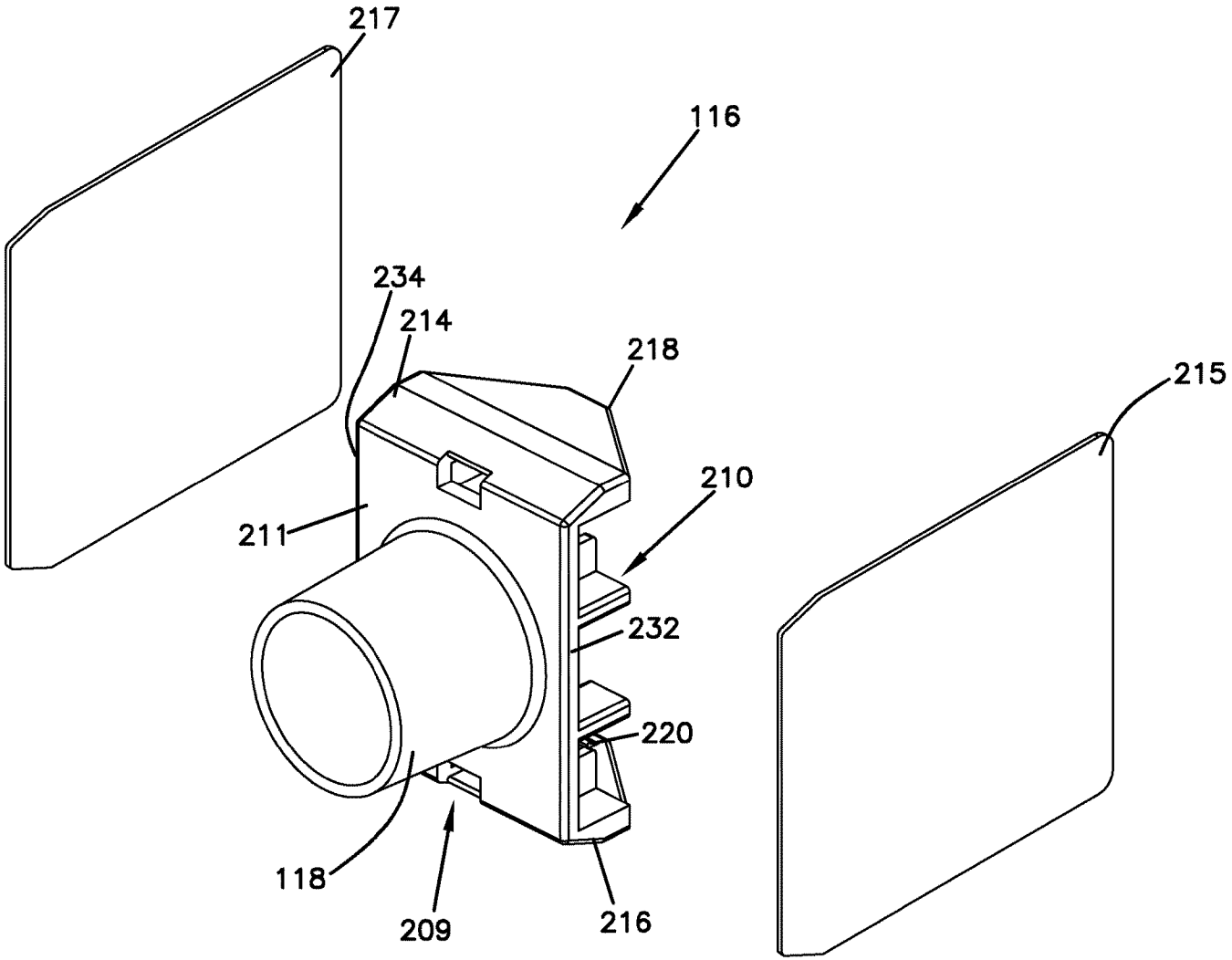
FIG. 5 is an expanded view of the shield cap of FIG. 4.
Figure 6:
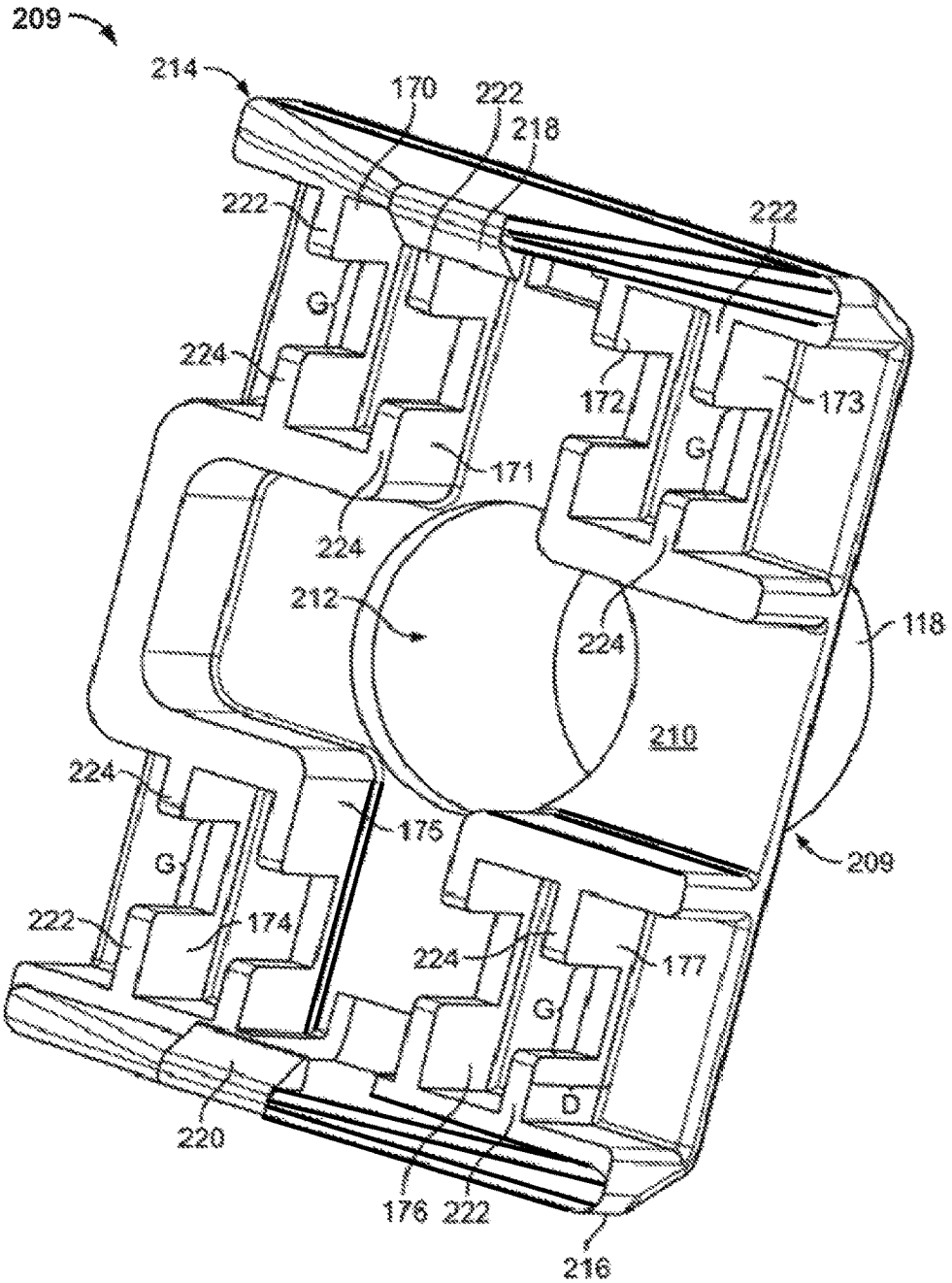
FIG. 6 is a perspective view of an exemplary body portion of the shield cap of FIGS. 4 and 5.

FIGS. 4-8 illustrate an exemplary shield cap 116 formed in accordance with the principles of the present disclosure. FIG. 4 is a perspective view of an exemplary shield cap 116 of FIGS. 1 and 2. FIG. 5 is an exploded view of the shield cap 116 of FIG. 4. FIG. 6 is a perspective view of an exemplary body portion 209 of the shield cap 116 of FIGS. 4 and 5. The shield cap 116 is configured to be coupled to the jack housing 109 and/or the contact subassembly 114 to at least partially cover the contact subassembly 114. In some examples, the shield cap 116 includes a hybrid structure having a main body of molded plastic material and opposite side shields made of sold metallic plates. For example, the shield cap 116 includes a body portion 209 having an inner surface 210 and an outer surface 211, and opposite shield plates 215 and 217. The inner surface 210 of the body portion 209 faces the contact subassembly 114 when the shield cap 116 engages the contact subassembly 114 (FIG. 1).

In addition to the cable sleeve 118 as described above, the body portion 209 further includes a cable sleeve opening 212, opposite sidewalls 214 and 216 and latch projections 218 and 220. The cable sleeve opening 212 is formed on the inner surface 210 and leads into and through the cable sleeve 118. The opposite sidewalls 214 and 216 extend outward at a substantially perpendicular angle with respect to the inner surface 210. In some examples, each sidewall 214 or 216 can taper or narrow as the sidewall 214 or 216 extends outward.

The latch projections 218 and 220 are formed on the sidewalls 214 and 216, respectively, for attaching the shield cap 116 to the contact subassembly 114 or the jack housing 109. In some examples, the latch projections 218 and 220 are integrally formed with the body portion 209. For example, as discussed below, where the body portion 209 is made from homogenous plastic, the latch projections 218 and 220 can be made from the same plastic so that the latch projections 218 and 220 are formed to be unitary with the plastic body portion 209. In some examples, the sidewalls 214 and 216 are configured to flex outward so that the shield cap 116 slides onto the contact subassembly 114 so that the latch projections 218 and 220 engage the corresponding engaging grooves 221 (FIG. 2). For example, as the shield cap 116 is inserted over the contact subassembly 114, each latch projection 218 and 220 slidably engages a corner or outer surface of the contact subassembly 114, thereby exerting an outward force on the sidewalls 214 and 216, respectively. The latch projections 218 and 220 continue to slide along the outer surface of the contact subassembly 114 until the latch projections 218 and 220 engage the engaging grooves 221 of the contact subassembly 114. In other examples, instead of the engaging grooves 221 of the contact subassembly 114, the jack housing 109 can have latch openings on the top side 126 and the bottom side 128 for engaging the latch projections 218 and 220.

The body portion 209 of the shield cap 116 is fabricated from a non-conductive material. In some examples, the body portion 209 is entirely made from a homogeneous non-conductive material without conductive materials or conductive particles. In some examples, the non-conductive material includes a polypropylene or other thermoplastic polymer. The non-conductive material may also include polymeric or plastic materials such as polycarbonate, ABS, and/or PC/ABS blend.

In other examples, the body portion 209 may be made from a plastic blended with a material adapted for reducing crosstalk. For example, the body portion 209 can be made from a non-conductive material having conductive particles dispersed therein. The conductive particles may include, for example, a conductive powder or conductive fibers. For example, the conductive particles may be carbon powders, carbon fibers, silver coated glass beads or fibers, nickel coated carbon fibers, or stainless steel fibers. By way of example, the body portion 209 may be formed in an injection molding process that uses pellets containing the non-conductive material and the conductive particles. The pellets may be made by adding a conductive powder or conductive fibers to molten resin. After extruding and cooling the resin mixture, the material may be chopped or formed into pellets. Alternatively, the conductive powder or fiber may be added during an injection molding process. The conductive particles form a conductive network that facilitates providing crosstalk, EMI and/or RFI shielding. When the body portion 209 of the shield cap 116 is ultimately formed, the conductive particles may be evenly distributed or dispersed throughout. Alternatively, the conductive particles may be distributed in clusters. Further, during the molding process, the conductive particles may be forced to move (e.g., through magnetism or applied current) to certain areas so that the density of the conductive particles is greater in desired areas.

The shield cap 116 further includes the opposite shield plates 215 and 217 for at least partially cover the contact subassembly 114 for reducing alien crosstalk between adjoining electrical connector assemblies 100. The opposite shield plates 215 and 217 are arranged to extend outward at a substantially perpendicular angle with respect to the inner surface 210 of the body portion 209 and adjacent the opposite sidewalls 214 and 216. The shield plates 215 and 217 are connected to opposite sides 232 and 234 of the body portion 209. In some examples, the shield plates 215 and 217 are symmetrically arranged on the body portion 209. In some examples, the shield plates 215 and 217 are configured to cover the contact subassembly 114 and at least partially the jack housing 108 when the body portion 209 engages the contact subassembly 114 or the jack housing 108. For example, as shown in FIG. 1, when the body portion 209 is coupled to the contact subassembly 114 by the latch projections 218 and 220, the opposite sidewalls 214 and 216 covers the opposite sides of the contact subassembly 114 adjacent the top side 126 and the bottom side 128, and the opposite shield plates 215 and 217 covers the other opposite sides of the contact subassembly 114 and at least partially the opposite sides 122 and 124 of the jack housing 108. Accordingly, the shield cap 116 encloses the IDC's 180 and the conductors 190 exposed at the contact subassembly 114 in the rear direction and shields them from other electrical components of adjacent electrical connector assemblies 100 (FIG. 10). Further, the shield cap 116 can shield other electrical components, such as the electrical contacts 134 and the circuit board, contained in the jack housing 108.

In particular, as shown in FIG. 10, the electrical connector assemblies 100 are arranged for high circuit density so that the sides 122 and 124 of the jack housings 108 are arranged close to one another in series. In this configuration, the opposite shield plates 215 and 217 are configured to cover the contact subassembly 104 and at least partially the sides 122 and 124 of the jack housing 108 so that the shield plates 215 and 217 reduce alien crosstalk that exists between the adjoining electrical connector assemblies 100. In other embodiments, the opposite shield plates 215 and 217 may cover the entire sides 122 and 124 of the jack housing 108 as well as the contact subassembly 114.

The shield plates 215 and 217 are made of solid metallic plates. Such solid metallic plates allow the shield plates 215 and 217 to be thin enough to save space when the electrical connector assemblies 100 are arranged as shown in FIG. 10. Further, the solid metallic plates enhance the strength of the shield plates 215 and 217 and show improved shielding performance. The shield plates 215 and 217 may be formed of any material suitable for minimizing crosstalk, EMI and/or RFI. The material may include, but not limited to, stainless steel, gold, nickel-plated copper, silver, silvered copper, nickel, nickel silver, copper or aluminum.

The shield plates 215 and 217 are not keyed to the body portion 209. Thus, the shield plates 215 and 217 are not fastened to the body portion 209 with fasteners. In some examples, the shield plates 215 and 217 are integrally formed with the body portion 209 in an overmolding process. In other examples, the shield plates 215 and 217 can be snap-fitted to the body portion 209. In yet other examples, the shield plates 215 and 217 are attached to the body portion 209 with adhesive.

In some examples, the shield plates 215 and 217 are self-supported to the body portion 209. In some examples, the shield plates 215 and 217 are configured to be removable from the body portion 209. For example, where one shield plate is only needed on the body portion 209, the other shield plate can be removed from the body portion 209.

Figure 7:
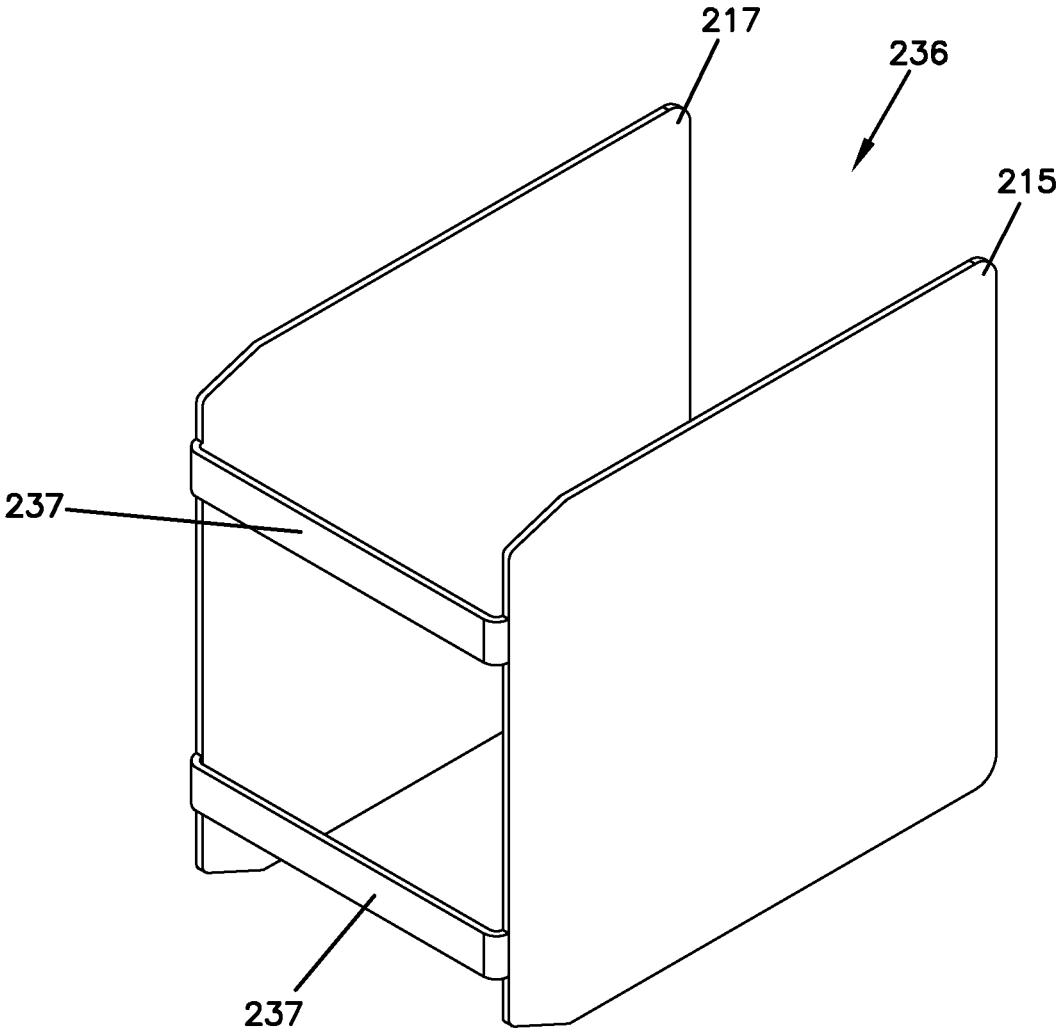
FIG. 7 is a perspective view of exemplary shield plates overmolded to the body portion of FIG. 6.

FIG. 7 is a perspective view of exemplary shield plates overmolded to the body portion of FIG. 6. In some examples, the shield plates 215 and 217 are made in one piece. For example, the shield plates 215 and 217 can be part of a unitary structure including the shield plates 215 and 217 interconnected by one or more cross-members 237. In the depicted example, the shield plates 215 and 217 can be made from a sheet metal by stamping process. For example, the shield plates 215 and 217 are stamped from a sheet metal so as to be interconnected by one or more cross members 237. Such a stamped metal sheet is bent as needed to produce the shield plates 215 and 217 as shown in FIG. 7. The shield plates 215 and 217 and the cross members 237 are used as a pre-mold insert. For example, the cross members 237 are placed into a mold for producing the body portion 209 before a plastic material is injected into the mold to produce the body portion 209.

Figure 8:
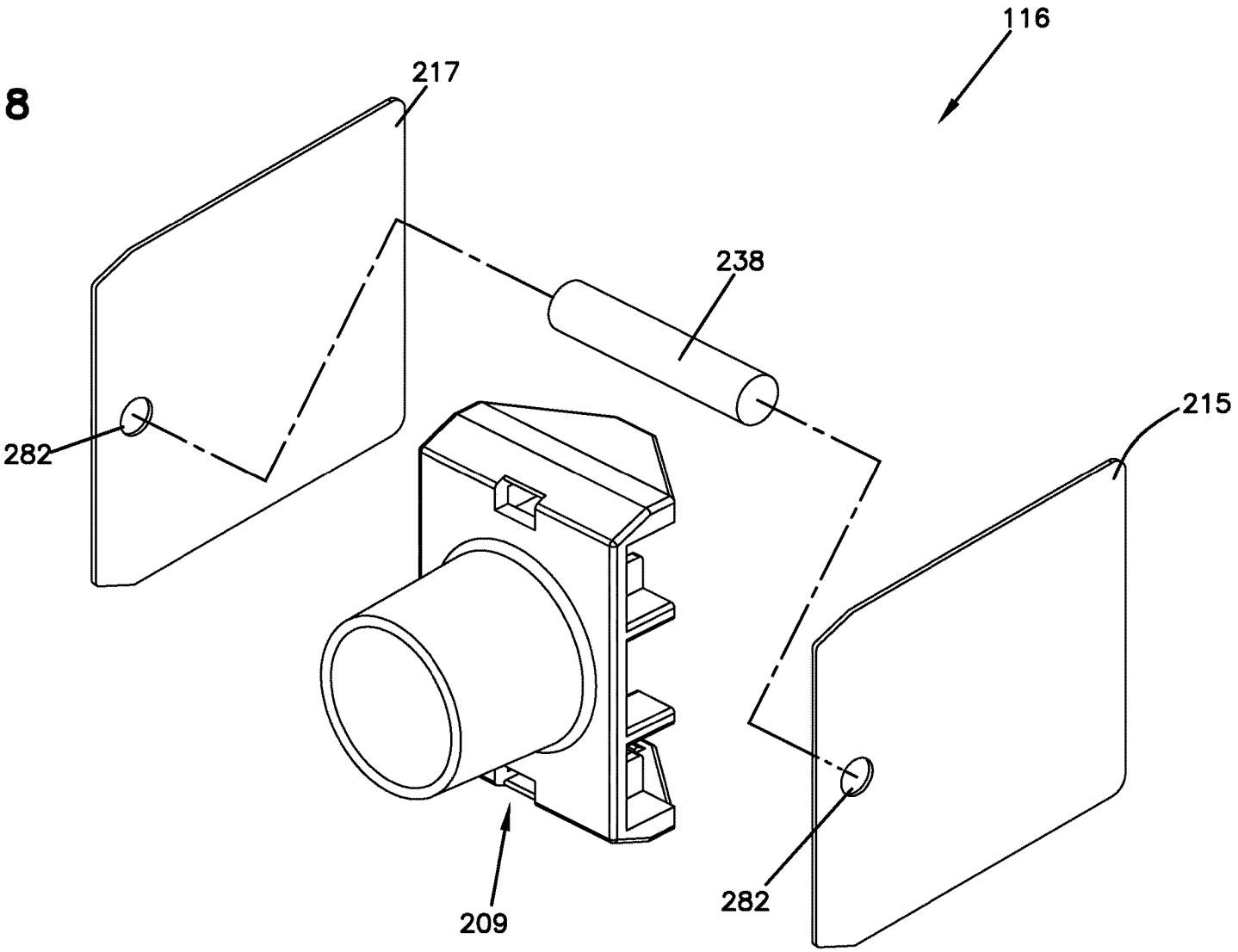
FIG. 8 is an expanded view of another exemplary shield cap with an exemplary support bar.

FIG. 8 is an expanded view of another exemplary shield cap with an exemplary support bar. In some examples, the shield plates 215 and 217 can be supported against the body portion 209, as well as against each other, by a support structure. For example, as shown in FIG. 8, a support bar 238 is configured to extend between the opposite shield plates 215 and 217 to secure the shield plates 215 and 217. In some examples, the support bar 238 is overmolded with other components, such as the body portion 209 and the shield plates 215 and 217. In some examples, the support bar can be integrally formed with the shield plates 215 and 217 and made from the same conductive material as the shield plates 215 and 217. In other examples, the shield plates 215 and 217 include bar holes 282 configured to receive and secure the ends of the support bar 238.

Referring again to FIG. 6, the body portion 209 includes cross walls 170-177. Each cross wall 170-177 includes a first wall portion 222, a second wall portion 224, and a gap G that separates the wall portions 222 and 224 from each other.

Figure 9A:
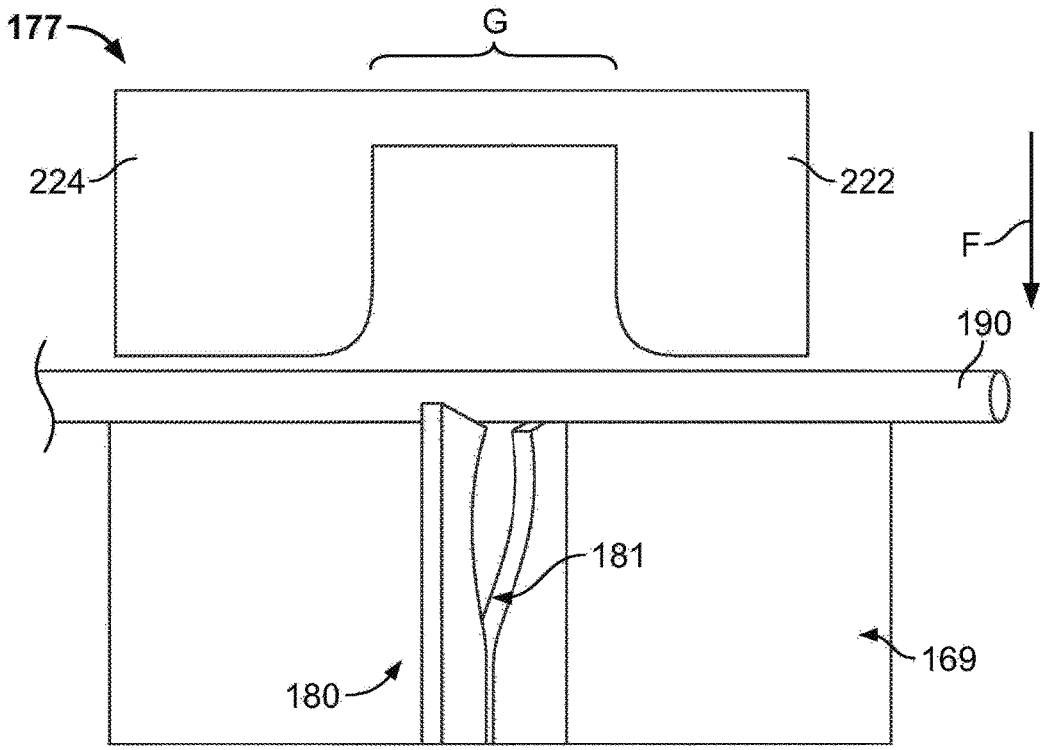
FIGS. 9A and 9B are side views of a cross wall and a conductor channel, illustrating that the cross wall engages an insulated wire conductor into the conductor channel 169 and a corresponding insulation displacement contact.
Figure 9B:
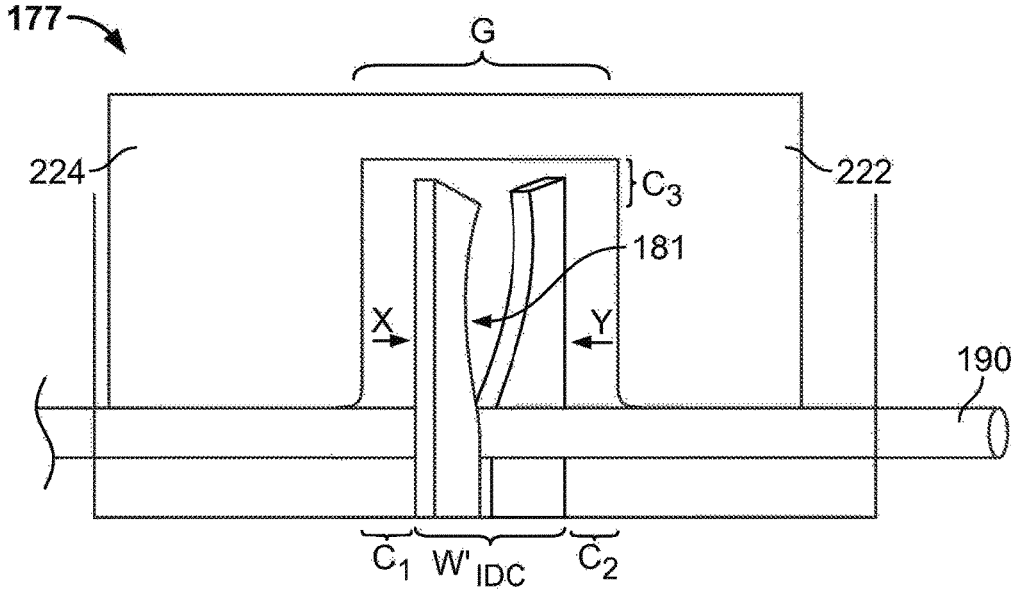

FIGS. 9A and 9B are side views of the cross wall 177 and the conductor channel 169 as the cross wall 177 engages the insulated wire conductor 190 and advances the conductor 190 into the conductor channel 169 and corresponding IDC 180. As shown, when the axial force F is applied to the shield cap 116 (FIG. 2), the wall portions 222 and 224 contact the wire conductor 190 and advance the wire conductor 190 through the slot 181. When the shield cap 116 and the contact subassembly 114 are engaged (FIG. 1), the wall portions 222 and 224 cooperate in providing strain relief for the wire conductor 190 and maintaining the wire conductor 190 in electrical contact with the IDC 180. The structure of the inner surface 210 of the body portion 209 and the engagement mechanism between the body portion 209 and the contact subassembly 114 are further described in U.S. Pat. No. 7,563,125, entitled "Jack Assembly for Reducing Crosstalk," to Paul John Pepe, et al. The entirety of the patent is herein incorporated by reference.

Figure 10A:
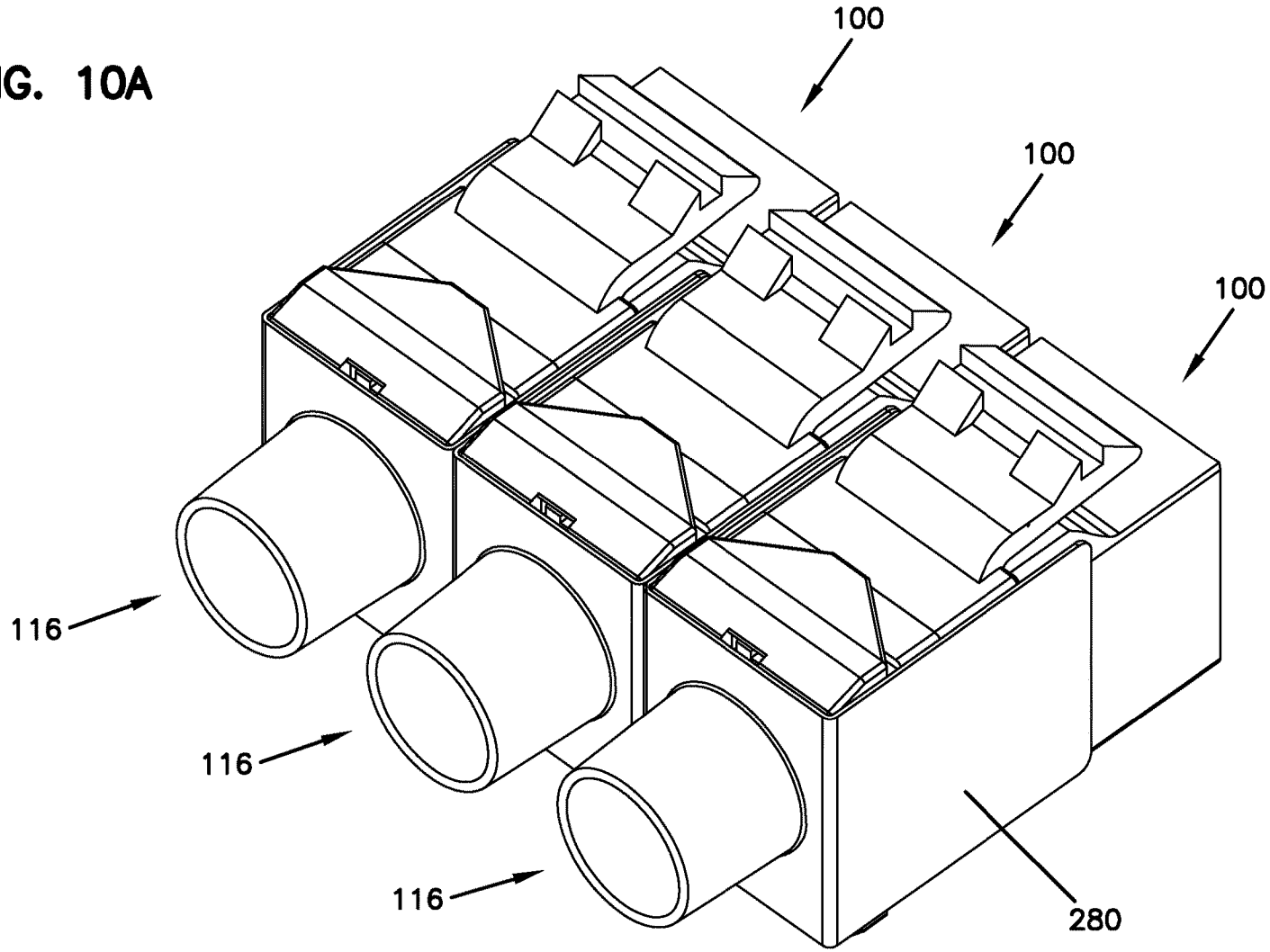
FIG. 10A is a perspective view of exemplary electrical connector assemblies adjoined to one another in a high density configuration.
Figure 10B:
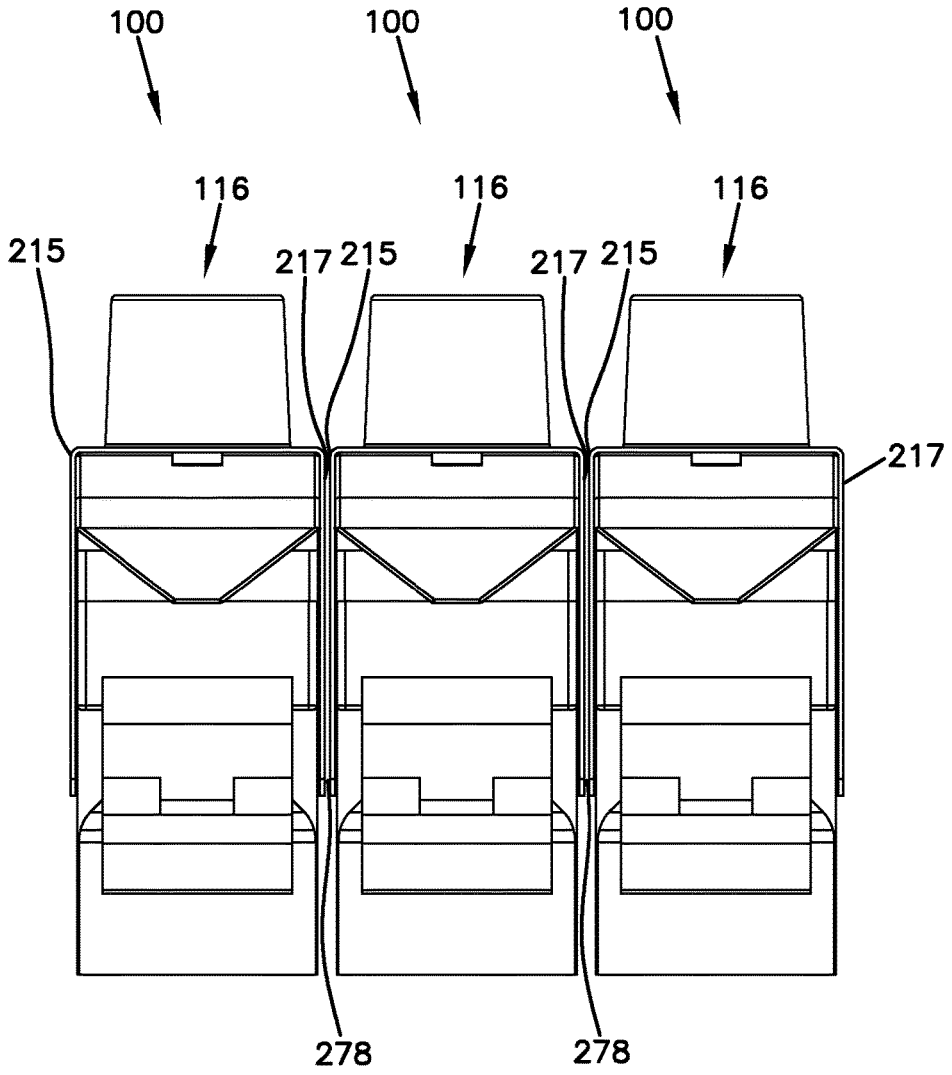
FIG. 10B is a top view of the electrical connector assemblies of FIG. 10B.

FIG. 10A is a perspective view of exemplary electrical connector assemblies arranged close to one another in a high density configuration. In particular, the electrical connector assemblies 100 are arranged for high circuit density so that the sides 122 and 124 of the jack housings 108 are arranged close to one another in series. In some examples, the shield plates 215 and 217 are not electrically connected between the adjacent assemblies 100. For example, the shield plate 215 of an assembly 100 is not electrically connected to the shield plate 217 of an adjacent assembly 100. In this configuration, the assemblies 100 may be shielded without ground connection, which is also referred to as electronic floating shield. In some examples, for the electronic floating shield, the assemblies 100 are spaced apart at a predetermined distance so that a gap 278 is formed between the shield plates 215 and 217 of the adjacent assemblies 100, as shown in FIG. 10B. The gap 278 operates as an electrical insulator between the adjacent assemblies 100. In other examples, the shield plates 215 and 217 may include a dielectric material 280 that operates to prevent the adjacent shield plates 215 and 217 from being electrically connected between adjoining assemblies 100. As shown in FIG. 10A, the shield plates 215 and 217 may be coated with the dielectric material, or covered with a dielectric film. In other examples, the shield plates may include one or more dielectric stubs, tabs or other projections, which are configured to maintain electric insulation between adjacent assemblies 100.

In some examples, the assembly 100 has only one shielding plate on either side 232 or 234 of the body portion 209. In this configuration, the assemblies 100 may be abutted to one another in series without the gap 278 or the dielectric material 280, as described above. When the assemblies 100 are abutted to one another, the assemblies 100 are not electrically connected to one another because the body portion 209 of one assembly 100, which is made from a non-conductive material, is arranged to touch the shield plate of the other assembly 100.

Figure 11:
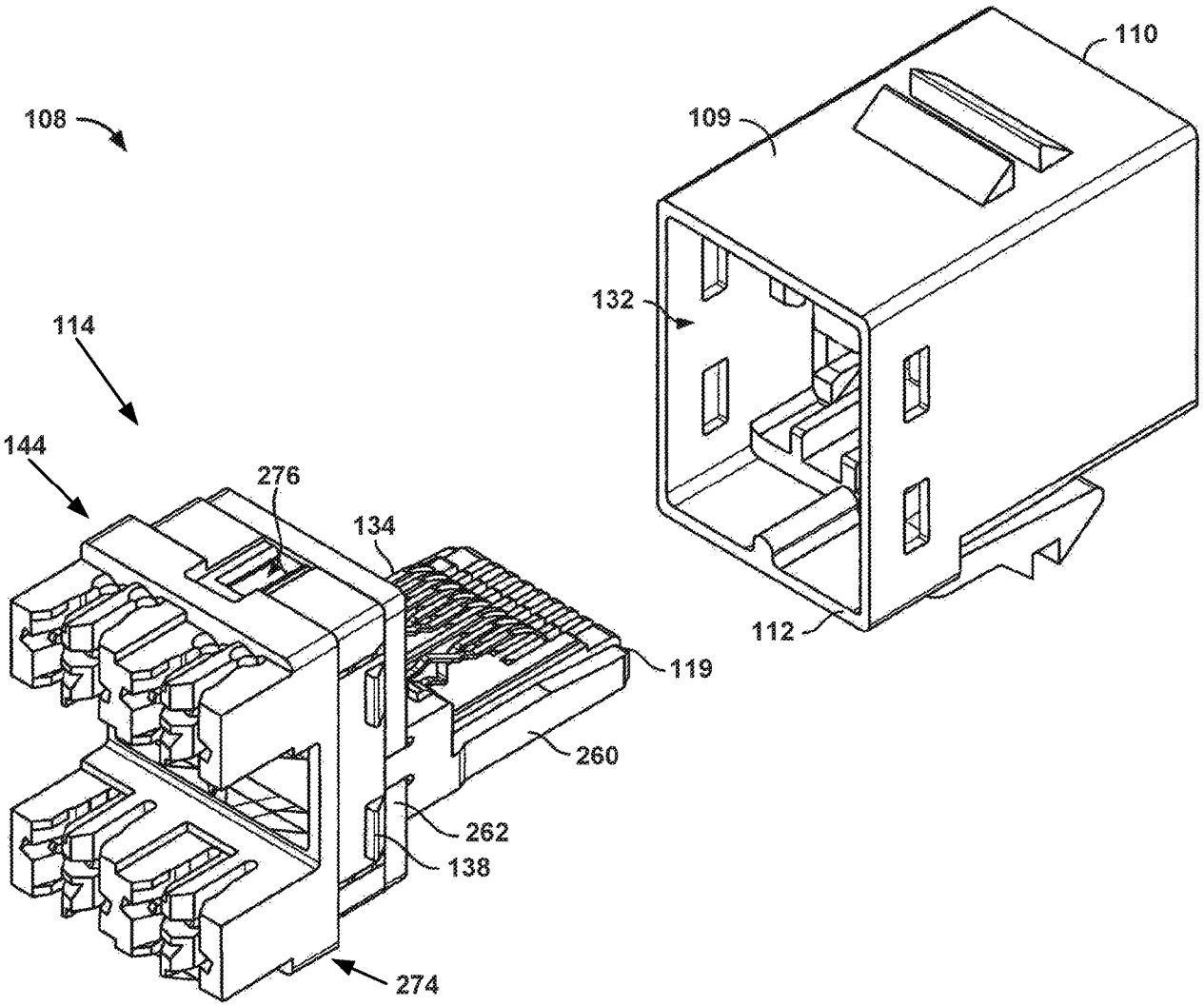
FIG. 11 is a rear perspective, exploded view of the electrical connector of FIG. 1.

In other examples, where the assembly 100 is shielded with a ground connection, adjacent assemblies 100 may be abutted in series so that the adjacent shield plates 215 and 217 are electrically connected to each other between the adjacent assemblies 100. In this configuration, the body portion 209 may incorporate a material for reducing crosstalk. For example, the body portion 209 can be made from a non-conductive material having conductive particles dispersed therein. The conductive particles may include, for example, a conductive powder or conductive fibers. For example, the conductive particles may be carbon powders, carbon fibers, silver coated glass beads or fibers, nickel coated carbon fibers, or stainless steel fibers. FIG. 11 is a rear perspective, exploded view of the electrical connector 100 of FIG. 1. In the depicted example, the rear end 112 of the jack housing 109 is open to the cavity 132 for receiving the contact subassembly 114.

The contact subassembly 114 includes the array of electrical contacts 134, a base 260, a circuit board 262, and a wire terminating structure 274. The base 260 extends from a mating end 119 of the contact subassembly 114 to the circuit board 262. The array of electrical contacts 134 is supported on the base 260. The wire terminating structure 274 extends rearward from the circuit board 262 to terminating portions 144, and is configured to hold a plurality of wire termination conductors 180 therein. The wire terminating structure 274 is sized to substantially fill the rear portion of the cavity 132. In some examples, the wire terminating structure 274 can include key features 276 for orienting the contact subassembly 114 with respect to the jack housing 109 during assembly. The terminating portions 114 are described below in further detail with reference to FIG. 3.

The contact subassembly 114 is loaded into the jack housing 109 through the rear end 112 thereof. When loaded, the base 260 is positioned proximate the front end 110 of the jack housing 109 such that the array of electrical contacts 134 are exposed to the cavity 132. The wire terminating structure 274 is partially received within the cavity 132 and substantially fills the rear portion of the cavity 132. Tabs 138 extending from the wire terminating structure 274 engage the jack housing 109 and secure the contact subassembly 114 to the jack housing 109. When assembled, the terminating portions 144 are exposed and configured to receive wire conductors of the cable 190 (FIG. 1). Alternatively, the wire conductors of the cable 190 may be terminated to the terminating portions 144 prior to loading the contact subassembly 114 into the jack housing 109.

Figure 12:
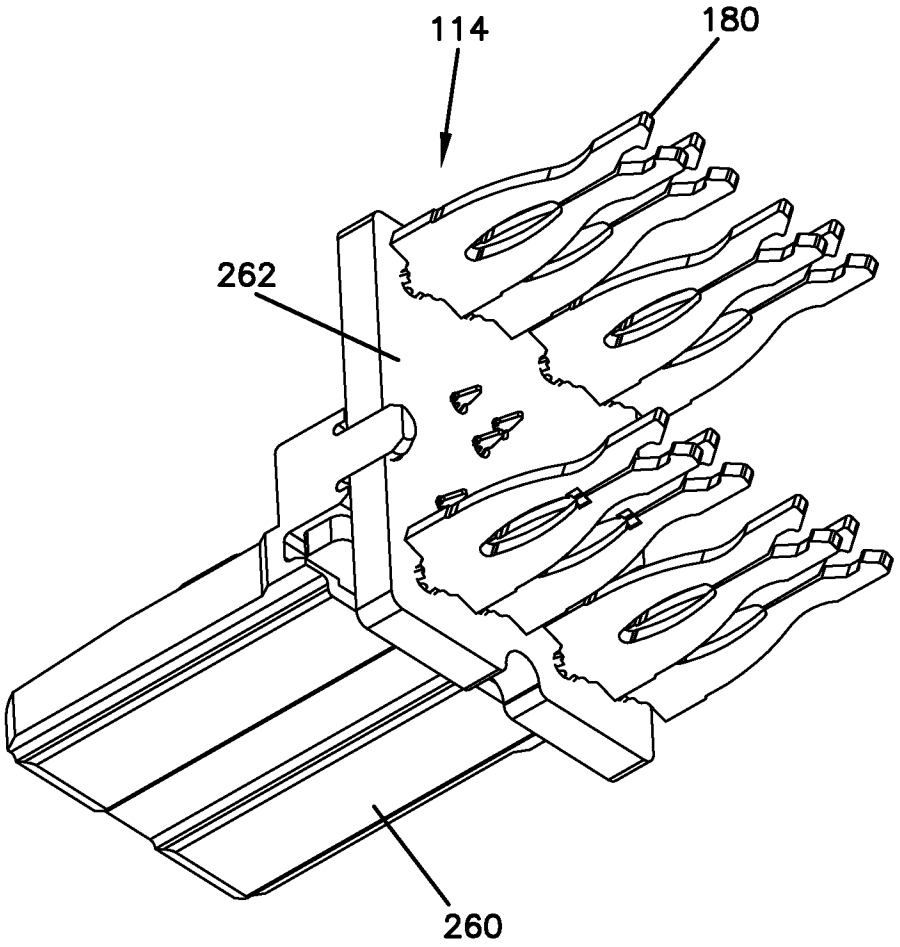
FIG. 12 is a perspective view of exemplary components of the contact subassembly of FIG. 11.
Figure 13:
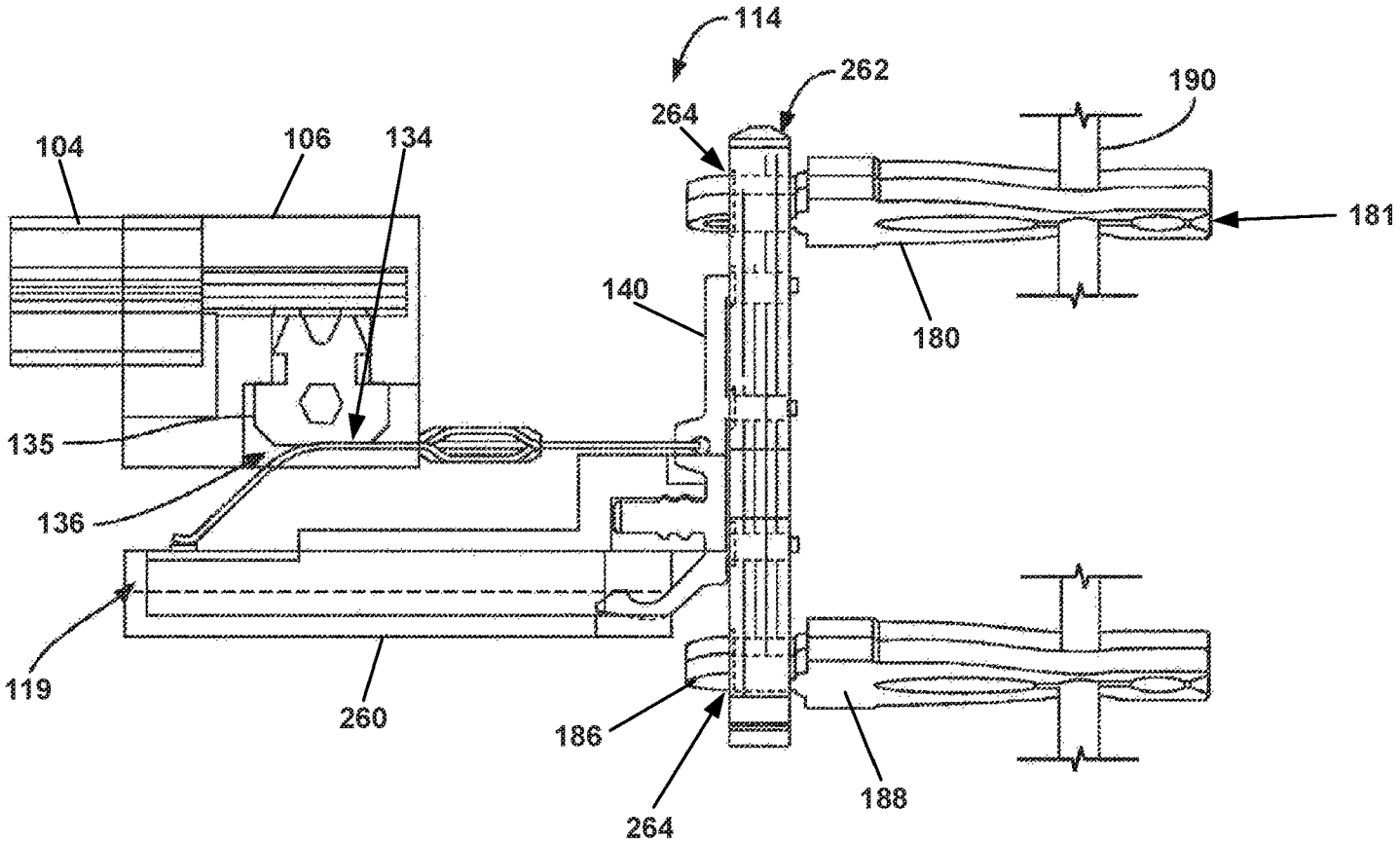
FIG. 13 is a side view of exemplary components of the contact subassembly of FIG. 11.

FIGS. 12 and 13 illustrate the contact subassembly 114 with the wire terminating structure 274 (FIG. 11) removed to better describe the structure of the wire termination conductors 180. FIG. 12 is a perspective view of exemplary components of the contact subassembly 114 of FIG. 11. FIG. 13 is a side view of exemplary components of the contact subassembly 114 of FIG. 11.

In the depicted example, the contact subassembly 114 further includes intermediate contacts 140 supported by the base 260 and engaged with the circuit board 262. As illustrated, each electrical contact 134 is connected to a corresponding intermediate contact 140. Each intermediate contact 140 is then connected to a corresponding wire termination conductor 180 through the circuit board 262. As described above, a wire conductor of the cable 190 is inserted into the slot 181 so as to engage a corresponding wire termination conductor 180. When the insulated wire 190 is inserted into the slot 181, opposing blades 274 (FIG. 14) defining the slot 181 cut through the insulation of the wire and exposes a conductor of the wire 190. As a result, the slot 181 embeds the conductor of the wire 190 therein, thereby making an electrical connection between the wire termination conductor 180 and the wire 190.

The array of electrical contacts 134 is configured to engage plug contacts 135 of the plug 106, respectively, at a mating interface 136 between the electrical connector 100 and the plug 106.

Figure 14A:
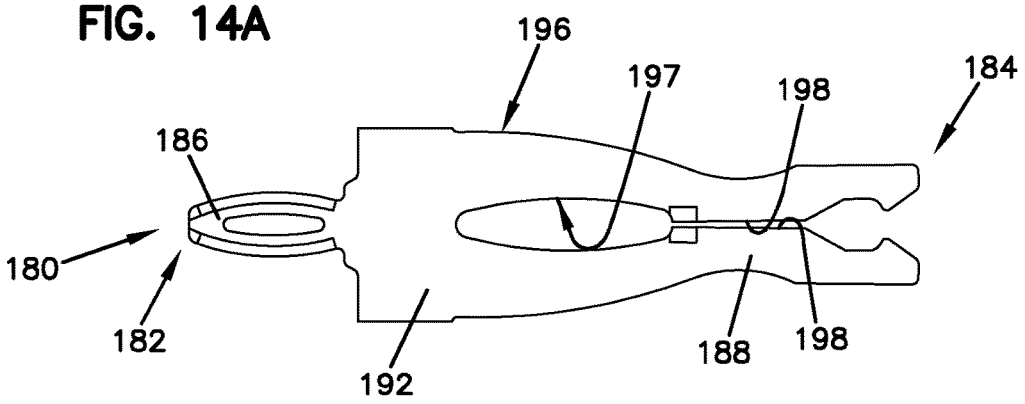
FIG. 14A is a top view of an exemplary wire termination conductor.
Figure 14B:
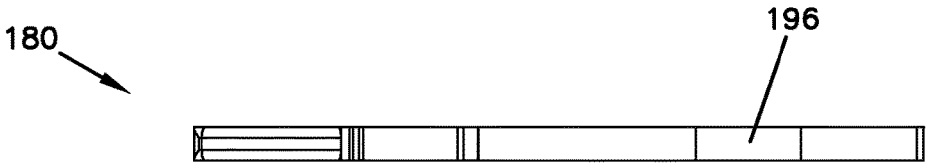
FIG. 14B is a side view of the wire termination conductor of FIG. 14A.
Figure 14C:
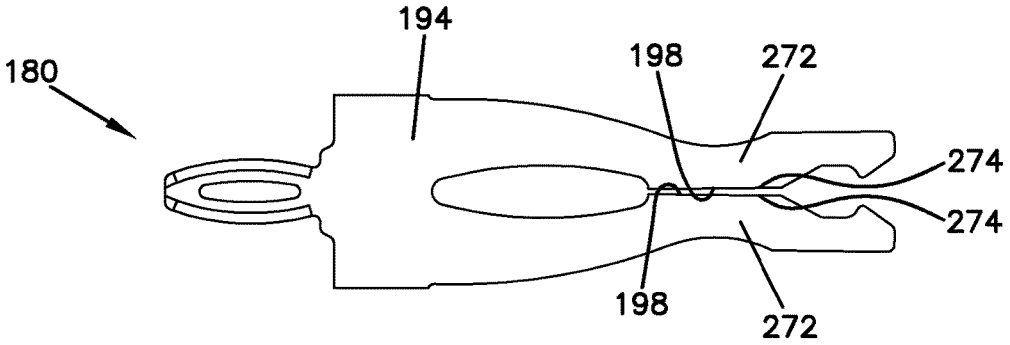
FIG. 14C is a bottom view of the wire termination conductor of FIG. 14A.

FIG. 14 illustrates an exemplary wire termination conductor 180. FIG. 14A is a top view of an exemplary wire termination conductor 180, FIG. 14B is a side view of the wire termination conductor 180 of FIG. 14A, and FIG. 14C is a bottom view of the wire termination conductor 180 of FIG. 14A.

In the depicted example, the wire termination conductor 180 has a fixed end 182 and a free end 184. The wire termination conductor 180 includes a support head 186 at the fixed end 182 and a wire engaging body 188 that extends from the support head 186 to the free end 184. As shown in FIG. 13, the support head 186 is inserted into a corresponding engaging hole 264 formed in the circuit board 262 so as to be supported by the circuit board 262. As described above, the support head 186 is electrically connected to a corresponding electrical contact 134 through the circuit board 262 and/or a corresponding intermediate contact 140.

As the support head 186 is held on the circuit board 262, the wire engaging body 188 extends from the circuit board 262 in a cantilever manner. In some examples, the wire engaging body 188 extends substantially at a perpendicular angle with respect to the circuit board 262. As describe above, the wire engaging body 188 includes the slot 181 for engaging the cable 190 and electrically connecting the wire termination conductor 180 with the wire conductor of the cable 190.

In some examples, the wire engaging body 188 has opposite major surfaces 192 and 194, a peripheral surface 196, and an internal surface 197. The peripheral surface 196 and the internal surface 197 extend between the opposite major surface 192 and 194. In particular, the peripheral surface 196 and the internal surface 197 are defined by side surfaces formed between the opposite major surfaces 192 and 194 along the contours of the opposite major surfaces 192 and 194.

The wire engaging body 188 includes a wire contact portion 198 configured to form an electrical contact with the wire conductor of the cable 190 within the slot 181 of the wire termination conductor 180. In some examples, the wire contact portion 198 includes opposing blade arms 272 and opposing blades 274 formed on the internal surface 197 of the opposing blade arms 272. The opposing blade arms 272 are configured to flex apart when the wire 190 is inserted into the slot 181. In the depicted example, the wire contact portion 198 is arranged on the internal surface 197 (e.g., a surface on which the opposing blades 274 are formed) of the wire engaging body 188.

Figure 15:
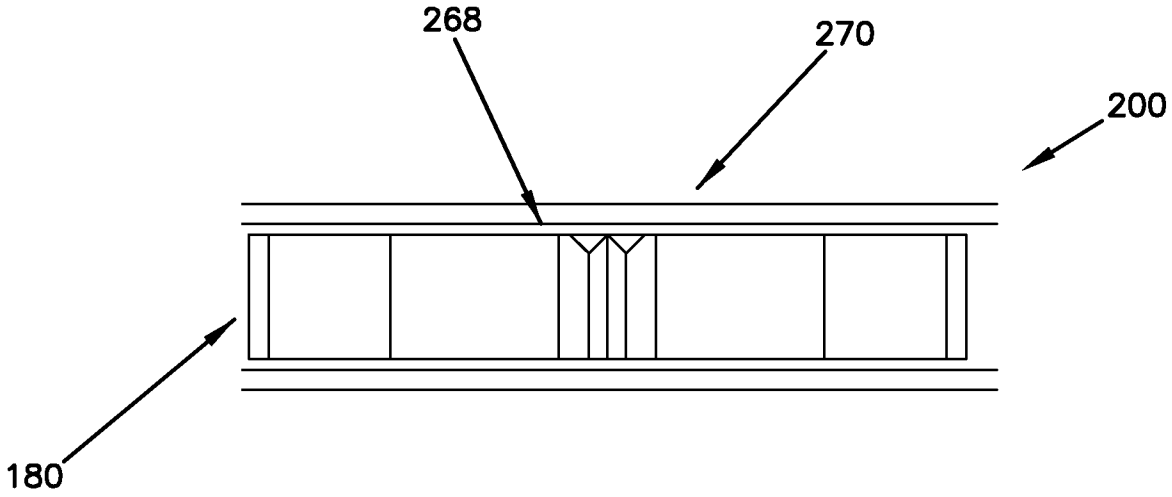
FIG. 15 is a side view illustrating an example of forming a shielding layer on a wire termination conductor.

FIG. 15 illustrates an example shielding layer 200 formed on a wire termination conductor 180. As shown, the wire termination conductor 180 is at least partially coated with the shielding layer 200. The shielding layer 200 is configured to provide EMI/RFI shielding between electrical connectors 100 arranged in high density configurations, thereby improving alien crosstalk performance. Further, the shielding layer 200 helps reducing or minimizing crosstalk between adjacent wire termination conductors 180 arranged within the same electrical connector 100.

The shielding layer 200 includes a shielding material adapted for reducing crosstalk between adjacent electrical connectors 100 and/or between adjacent wire termination conductors 180. In the depicted example, the shielding layer 200 includes a first layer 268 and a second layer 270. The first layer 268 is formed on at least a portion of the wire termination conductor 180. The second layer 270 is formed on at least a portion of the first layer 268.

In some examples, the first layer 268 is formed with a dielectric material, which provides an electrical insulation layer. Examples of the dielectric material include a variety of polymer. As described below, in some examples, the first layer 268 may be formed by powder coating. Candidate powder materials include, but not limited to, High Density Polyethylene (HDPE), Scotchcast 5400, AkzoNobel Corvel 78-7001, Scotchcast 265, Dupont Abcite 9016, AkzoNobel Corvel 17-7005, AkzoNobel Corvel 17-7004, AkzoNobel Corvel 17-11002, Scotchcast 5133, Scotchcast 260, Scotchcast 5230N, and AkzoNobel Corvel 17-4001.

In some example, the second layer 270 is formed with a conductive material. For example, the second layer 270 may be formed with a conductive ink. Preferably, the conductive ink includes a silver ink. In other examples, however, the second layer 126 may be formed of any conductive material suitable for minimizing crosstalk, EMI and/or RFI. Examples of the conductive material include, but not limited to, stainless steel, gold, nickel-plated copper, silver, silvered copper, nickel, nickel silver, copper or aluminum.

The shielding layer 200 may be formed only on an exposed portion of the wire termination conductor 180. In the depicted example, the shielding layer 200 is coated only on at least a portion of the wire engaging body 188, and may not be formed on the support head 186. As described above, the support head 186 is configured to be inserted into the electrical connector 100 through the circuit board 262, thereby hidden from the outside of the electrical connector 100. On the other hand, the wire engaging body 188 extends from the electrical connector 100 and exposed to the outside thereof. Thus, forming the shielding layer 200 on the wire engaging body 188 is sufficient to reduce crosstalk, EMI and/or RFI between adjacent wire termination conductors 180 within the same electrical connector 100 and/or between wire termination conductors 180 of adjacent electrical connectors 100.

In some examples, the shielding layer 200 may be formed only on a portion of the wire termination conductor 180, provided that the wire contact portion 198 of the wire termination conductor 180 is provided for an electrical contact with the wire conductor of the cable 190. In the depicted example, the shielding layer 200 is formed only on the opposite major surfaces 192 and 194. The shielding layer 200 is not formed on the peripheral surface 196 or the internal surface 197 so that the wire contact portion 198 is saved from being covered by the shielding layer 200 and, thus, properly operates as an electrical contact point with the wire conductor of the cable 190. In other examples, the peripheral surface 196 can be coated while the internal surface 197 is not coated.

A thickness of the shielding layer 200 (the first layer 268 and/or the second layer 270) may be varied based upon several factors, such as a level of crosstalk, EMI and/or RFI. The thickness of the shielding layer 200 may be varied among the wire termination conductors 180 or may be substantially the same for all the wire termination conductors 180. In some examples, the first layer 268 is thicker than the second layer 270. In some embodiments, the thickness of the first layer 268 can range between 0.12 mm and 0.26 mm, and the thickness of the second layer 270 can range between 0.08 mm and 0.2 mm. In some examples, the thickness of the first layer 268 is about 0.15 mm, and the thickness of the second layer 270 is about 0.10 mm. In other embodiments, the first and second layers 268 and 270 can have other thicknesses as well.

The first layer 268, which is a dielectric layer, may be formed by various processes, such as, but not limited to, powder coating. In some examples, the first layer 268 may be provided on the wire termination conductor 180 by applying electrically insulative particles onto the surface of the wire termination conductor 180. For example, the first layer 268 may be formed by spraying, sputtering, depositing, or adhering dielectric particles onto a predetermined portion of the wire termination conductor. In one example, the first layer 268 is formed by electrostatically charging polymer particles, either thermosets or thermoplastics. In another example, the first layer 268 is formed by a fluidized bed process. The powder particles cling to the wire termination conductor 180 due to their opposite charge polarity. The larger the charge difference and the longer the wire termination conductor 180 is exposed to the powder, the thicker the first layer 268 builds up. Once the required thickness is reached, the coated conductor 180 is transferred to a thermal curing oven where the powder gels and solidifies forming a durable polymer coating. In yet another example, the first layer 268 is formed by spraying an epoxy onto the wire engaging body 188 of the wire termination conductor 180. In still another example, the first layer 268 is formed by dipping the wire engaging body 188 into a bath or other containers that include a fluid comprising a dielectric material. The support head 186 of the wire termination conductor 180 and/or any other portions on which the first layer 268 is not desired may be masked off prior to spraying the remaining exposed portion of the wire termination conductor 180 with a dielectric material or dipping the exposed portion of the wire termination conductor 180 into a bath that includes the dielectric material. Alternatively, the first layer 268 may be provided on the wire termination conductor 180 by adhering electrically insulative films to the predetermined portion of the wire termination conductor 180. For example, the first layer 268 may be polyimide film that is joined to the predetermined portion of the wire termination conductor 180.

The second layer 270, which is a conductive ink layer, may be formed by various processes, such as printing processes. Examples of printing processes include screen, gravure, pad, ink-jet and aerosol-jet printings.

The shielding layer 200 on the wire termination conductor 180 according to the present disclosure is advantageous where a plurality of the wire termination conductors 180 are closely arranged in the electrical connector 100 as described in the depicted examples, and/or whether a plurality of electrical connectors 100 are arranged closely arranged or abutted to one another, as found in high density patch panels, for example.

In some examples, the wire termination connector 180 with the shielding layer 200, as shown in FIG. 15, and the shield cap 116, as shown in FIGS. 1, 2, 4, 5, 7, 8, and 10, may be independently implemented in the connector assembly 100. For example, the connector assembly 100 may include either the shielding layer 200 or the shield cap 116, but not both. In other examples, the configurations of the shielding layer 200 and the shield cap 116 are both implemented in the connector assembly 100.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. An electrical connector comprising:

a connector housing having front and rear ends and configured to receive a plug at the front end;

an electrical contact configured for engaging a corresponding electrical contact of the plug; and a wire termination conductor connected to the electrical contact and extending from the connector housing at the rear end, the wire termination conductor configured to be connected to a wire conductor of a cable, and at least partially coated with a shielding layer, wherein the shielding layer is formed on opposite major surfaces of the wire termination conductor and includes a first layer and a second layer formed above the first layer, the first layer formed with a dielectric material, and the second layer formed with a conductive ink printed over the first layer, and wherein a wire engaging body of the wire termination conductor has a wire contact portion configured to form an electrical contact with the wire conductor of the cable, the wire contact portion excluded from being coated with the shielding layer.

2. The electrical connector of claim 1, wherein the shielding layer is adapted for reducing crosstalk between adjacent electrical connectors, and between adjacent wire termination conductors.

3. The electrical connector of claim 1, wherein the dielectric material is a polymer.

4. The electrical connector of claim 1, wherein the conductive ink is a silver ink.

5. The electrical connector of claim 1, wherein the wire termination conductor includes an insulation displacement contact (IDC), and wherein the shielding layer is at least partially coated on opposite major sides of the IDC.

6. The electrical connector of claim 1, wherein the shielding layer is not formed on an internal surface of the wire engaging body, the internal surface positioned between the opposite major sides.

7. The electrical connector of claim 6, wherein the shielding layer is not formed on a peripheral surface of the wire engaging body, the peripheral surface positioned between the opposite major sides.

8. A wire termination conductor used for an electrical connector, the wire termination conductor comprising:

a support head supported by the electrical connector; and a wire engaging body extending from the electrical connector and connected to a wire conductor of a cable, the wire engaging body at least partially coated with a shielding layer, wherein the shielding layer is formed on opposite major surfaces of the wire termination conductor and includes a first layer and a second layer formed above the first layer, the first layer formed with a dielectric material, and the second layer formed with a conductive ink printed over at least a portion of the first layer, and wherein the wire engaging body has a wire contact portion configured to form an electrical contact with the wire conductor of the cable, the wire contact portion excluded from being coated with the shielding layer.

9. The wire termination conductor of claim 8, wherein the shielding layer is adapted for reducing crosstalk between adjacent electrical connectors, and between adjacent wire termination conductors.

10. The wire termination conductor of claim 8, wherein the dielectric material is a polymer.

11. The wire termination conductor of claim 8, wherein the conductive ink is a silver ink.

12. The wire termination conductor of claim 8, wherein the wire termination conductor includes an insulation displacement contact (IDC), wherein the shielding layer is at least partially coated on opposite major sides of the wire engaging body of the IDC.

13. A method of forming a shielding layer on a wire termination conductor used for an electrical connector, the method comprising:

forming a first layer on at least one major surface of the wire termination conductor, wherein the first layer includes a dielectric material; and forming a second layer on at least a portion of the first layer, wherein the second layer includes a conductive material, and wherein forming the second layer includes:

printing a conductive ink; and wherein the wire termination conductor includes a wire engaging body having a wire contact portion configured to form an electrical contact with a wire conductor of a cable, and the wire contact portion is excluded from being coated with the shielding layer.

14. The method of claim 13, wherein the step of forming the first layer is performed by powder coating with polymer particles.

15. The method of claim 13, wherein the step of forming the second layer is performed by a printing process with silver ink.

16. The method of claim 13, wherein the wire termination conductor includes an insulation displacement contact (IDC), and wherein the first layer and the second layer are formed on opposite major sides of the IDC.

* * * * *